US009239022B2

(12) United States Patent
Tsuji et al.

(10) Patent No.: US 9,239,022 B2
(45) Date of Patent: Jan. 19, 2016

(54) CONTROL DEVICE OF INTERNAL COMBUSTION ENGINE

(75) Inventors: Kanta Tsuji, Saitama (JP); Atsushi Mitsui, Saitama (JP); Fumio Hara, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 675 days.

(21) Appl. No.: 13/580,932

(22) PCT Filed: Feb. 14, 2011

(86) PCT No.: PCT/JP2011/053033

§ 371 (c)(1),
(2), (4) Date: Aug. 23, 2012

(87) PCT Pub. No.: WO2011/105244

PCT Pub. Date: Sep. 1, 2011

(65) Prior Publication Data

US 2012/0330535 A1 Dec. 27, 2012

(30) Foreign Application Priority Data

Feb. 23, 2010 (JP) ..... 2010-036980

(51) Int. Cl.
*F02D 41/06* (2006.01)
*F02N 11/08* (2006.01)
(Continued)

(52) U.S. Cl.
CPC ..... *F02D 29/02* (2013.01); *F02D 41/009* (2013.01); *F02D 41/062* (2013.01); *F02N 11/0814* (2013.01); *F02D 2041/0092* (2013.01)

(58) Field of Classification Search
CPC ..... F02N 11/0814; F02N 11/0829; F02N 11/0844; F02N 19/005; F02N 2019/008; F02N 99/002; F02N 99/004; F02N 99/006; F02D 41/06; F02D 41/062; F02D 41/065; F02D 2041/0095
See application file for complete search history.

(56) References Cited

U.S. PATENT DOCUMENTS 5,390,641 A 2/1995 Yamada et al.
5,934,259 A 8/1999 Onishi
(Continued)

FOREIGN PATENT DOCUMENTS

CN 1464187 12/2003
DE 199 63 516 A1 8/2000
(Continued)

OTHER PUBLICATIONS

Supplementary European Search Report, European Patent Application 11747208.4 dated Nov. 14, 2013.
(Continued)

*Primary Examiner* — Erick Solis
*Assistant Examiner* — Anthony L Bacon
(74) *Attorney, Agent, or Firm* — Mori & Ward, LLP

(57) ABSTRACT

Disclosed is an internal-combustion engine controller capable of improving emission characteristics at a start of an internal-combustion engine. When injection during an exhaust stroke is controlled in a port-injection engine, the engine controller ECU performs the first fuel injection during $t_1$ to $t_2$ according to a memory-based crank angle as illustrated in FIG. 12(*b*) at a fuel injection timing before determination of an actual stroke. Thus, the injected fuel has been introduced into a cylinder during the actual stroke. If fuel is not injected during $t_{1N}$ to $t_{3N}$ within the next exhaust stroke as denoted by the solid line, this causes misfire in the cylinder, so that the engine rotation at the start cannot be smooth. Thus, the ECU clears a finished fuel injection flag (F_INJ) at an incorrect crank angle storage determination timing ($t_{JUD}$) as denoted by the dashed-dotted line, thereby capable of controlling the fuel injection.

12 Claims, 20 Drawing Sheets

(51) Int. Cl.
*F02D 29/02* (2006.01)
*F02D 41/00* (2006.01)

(56) References Cited

U.S. PATENT DOCUMENTS

| | | | | |
|---|---|---|---|---|
| 6,112,723 | A * | 9/2000 | Itoyama et al. | 123/491 |
| 6,218,799 | B1 | 4/2001 | Hori | |
| 2005/0109302 | A1 * | 5/2005 | Tetsuno et al. | 123/179.5 |
| 2005/0212509 | A1 | 9/2005 | Asama | |

FOREIGN PATENT DOCUMENTS

| | | | |
|---|---|---|---|
| JP | 06-173746 | | 6/1994 |
| JP | 6-173746 | A | 6/1994 |
| JP | 07-103025 | | 4/1995 |
| JP | 7-103025 | A | 4/1995 |
| JP | 2005-273566 | A | 10/2005 |
| JP | 2005-320945 | | 11/2005 |
| JP | 2005-320945 | A | 11/2005 |
| JP | 2006-214408 | | 8/2006 |
| JP | 2006-214408 | A | 8/2006 |

OTHER PUBLICATIONS

Japanese Office Action for corresponding JP Application No. 2012-501742, Apr. 24, 2014.
Chinese Office Action for corresponding CN Application No. 201180010643.9, Sep. 17, 2014.
Chinese Office Action for corresponding CN Application No. 201180010643.9, Jun. 1, 2015.

* cited by examiner

NORMAL DRIVING

EXAMPLE 1 REPRESENTING STORAGE OF INCORRECT CRANK ANGLE

NORMAL DRIVING

EXAMPLE 2 REPRESENTING STORAGE OF INCORRECT CRANK ANGLE

NORMAL DRIVING

EXAMPLE 3 REPRESENTING STORAGE OF INCORRECT CRANK ANGLE

NORMAL DRIVING

EXAMPLE 1 REPRESENTING STORAGE OF INCORRECT CRANK ANGLE

NORMAL DRIVING

EXAMPLE 2 REPRESENTING STORAGE OF INCORRECT CRANK ANGLE

CONTROL DEVICE OF INTERNAL COMBUSTION ENGINE

CROSS-REFERENCE TO RELATED APPLICATION

This application is a National Stage entry of International Application No. PCT/JP2011/053033 filed Feb. 14, 2011, which claims priority to Japanese Patent Application No. 2010-036980, filed Feb. 23, 2010, the disclosure of the prior applications are hereby incorporated in their entirety by reference

TECHNICAL FIELD

The present invention relates to internal-combustion engine controllers for a vehicle, and in particular to fuel injection control at the time of starting an internal-combustion engine.

BACKGROUND ART

Conventionally, techniques have been known that efficiently determine a cylinder at the time of starting an internal-combustion engine. For example, Patent Literature 1 discloses a technology including: monitoring a crank angle position even during stoppage of an internal-combustion engine; calculating, based on the result, a crank angle at the time of starting the internal-combustion engine; and determining a cylinder of which a fuel injection is performed. In addition, Patent Literature 1 discloses a technique including: a first determination unit which determines a cylinder based on information regarding a crank angle position at the time of stopping an internal-combustion engine; and a second determination unit which determines a cylinder by using a combination of different Hi/Low logic signals of a cam angle sensor (corresponding to a "TDC sensor" as described herein), whereby a fuel injection is controlled at the time of starting the internal-combustion engine. Then, when a mismatch occurs between the results of the cylinder determined by the first determination unit and the cylinder determined by the second determination unit and fuel has already been injected based on the cylinder determination by the first determination unit, an amount of subsequent fuel injection of the cylinder is compensated by subtraction.

CITATION LIST

Patent Literature

Patent Literature 1: JP2005-320945A

SUMMARY OF INVENTION

Technical Problem

Unfortunately, when a mismatch occurs between the results of the cylinder determined by the first determination unit and the cylinder determined by the second determination unit and fuel has already been injected based on the cylinder determination by the first determination unit, the technique disclosed in Patent Literature 1 fails to determine whether or not the injected fuel is introduced into the cylinder. Consequently, even if a whole amount of the injected fuel has been introduced into the cylinder, an amount of fuel injection at the next cycle is always reduced. This makes fuel shortage occur at the next cycle, which may lead to misfire or deterioration of emission gas.

It is an object of the present invention to provide an internal-combustion engine controller capable of improving emission characteristics at the time of starting an internal-combustion engine.

Solution to Problem

In order to solve the above problem, the first aspect of the present invention provides an internal-combustion engine controller, including: a cylinder-determining information storing unit which stores cylinder-determining information at a time of stopping an internal-combustion engine; an actual stroke-determining unit which determines an actual stroke of each cylinder of the internal-combustion engine; a fuel injection-controlling unit which injects fuel toward a predetermined cylinder based on the stored cylinder-determining information and which injects, after the determination of the actual stroke by the actual stroke-determining unit, an amount of fuel injection corresponding to a driving condition at a fuel injection timing corresponding to the actual stroke to start the internal-combustion engine; and an injection timing-determining unit which determines whether or not the fuel injected toward the predetermined cylinder based on the stored cylinder-determining information and fuel to be injected at a first fuel injection timing after the determination of the actual stroke of the predetermined cylinder by the actual stroke-determining unit are combined at the same combustion timing, wherein the fuel injection-controlling unit controls, based on a result of the determination by the injection timing-determining unit, a fuel injection at the first fuel injection timing after the determination of the actual stroke of the predetermined cylinder.

According to the first aspect of the present invention, an internal-combustion engine controller to start an internal-combustion engine injects fuel toward a predetermined cylinder based on stored cylinder-determining information at the time of the last stoppage. This controller can determine whether or not fuel injected toward the predetermined cylinder based on the stored cylinder-determining information before determination of an actual stroke and fuel to be injected at the first fuel injection timing after the determination of the actual stroke of the predetermined cylinder are combined at the same combustion timing. As a result, depending on the determination result, the fuel injection is controlled at the first fuel injection timing after the determination of the actual stroke of the predetermined cylinder. This can prevent incorrect fuel injection at the first fuel injection after the determination of the actual stroke of the predetermined cylinder. This can also prevent deterioration of starting and emission characteristics of an internal-combustion engine.

The second aspect of the present invention provides, in addition to elements of the first aspect, the internal-combustion engine controller, wherein when the injection timing-determining unit determines that the fuel injected toward the predetermined cylinder based on the stored cylinder-determining information and the fuel to be injected at the first fuel injection timing after the determination of the actual stroke of the predetermined cylinder are not combined at the same combustion timing, the fuel injection-controlling unit controls a fuel injection at the amount of fuel injection corresponding to the driving condition at the first fuel injection timing after the determination of the actual stroke of the predetermined cylinder; and wherein when the injection timing-determining unit determines that the fuel injected toward the predetermined cylinder based on the stored cylinder-determining information and the fuel to be injected at the first fuel injection timing after the determination of the actual stroke of the predetermined cylinder are combined at the same combustion timing, the fuel injection-controlling unit does not perform a fuel injection at the first fuel injection timing after the determination of the actual stroke of the predetermined cylinder.

According to the second aspect of the present invention, when the fuel injected toward the predetermined cylinder based on the stored cylinder-determining information before the determination of the actual stroke and the fuel to be injected toward the predetermined cylinder at the first fuel injection timing after the determination of the actual stroke are determined not to be combined at the same combustion timing, the fuel injection is performed at the first fuel injection timing after the determination of the actual stroke of the predetermined cylinder. When the fuel to be injected at the first fuel injection timing after the determination of the actual stroke of the predetermined cylinder is determined to be combined at the same combustion timing, the fuel injection is not performed. As a result, in the former case, misfire can be prevented. In the latter case, emission deterioration due to excessive fuel can be prevented.

The third aspect of the present invention provides, in addition to elements of the first aspect, the internal-combustion engine controller, wherein the internal-combustion engine is a port-injection internal-combustion engine whose fuel injection valve is disposed in an intake passage; and the injection timing-determining unit determines whether or not the fuel injected toward the predetermined cylinder based on the stored cylinder-determining information and the fuel to be injected at the first fuel injection timing after the determination of the actual stroke of the predetermined cylinder are combined at the same combustion timing, by determining whether or not a stroke at the determination of the actual stroke of the predetermined cylinder is before bottom dead center during an intake stroke.

The fourth aspect of the present invention provides, in addition to elements of the second aspect, the internal-combustion engine controller, wherein the internal-combustion engine is a port-injection internal-combustion engine whose fuel injection valve is disposed in an intake passage; and the injection timing-determining unit determines whether or not the fuel injected toward the predetermined cylinder based on the stored cylinder-determining information and the fuel to be injected at the first fuel injection timing after the determination of the actual stroke of the predetermined cylinder are combined at the same combustion timing, by determining whether or not a stroke at the determination of the actual stroke of the predetermined cylinder is before bottom dead center during an intake stroke.

According to the third and fourth aspects of the present invention, it is determined in a port-injection internal-combustion engine whether or not a stroke at the determination of the actual stroke of the cylinder having a fuel injection based on the stored cylinder-determining information before the determination of the actual stroke is before bottom dead center during an intake stroke. Depending on this determination, it is determined whether or not fuel injected, based on the stored cylinder-determining information, before the determination of the actual stroke and fuel to be injected at the first fuel injection timing after the determination of the actual stroke of the cylinder of which an injection has been performed before the determination of the actual stroke are combined at the same combustion timing. Thus, the resulting fuel combustion state can be definitely identified in respect to the fuel which has been injected before the determination of the actual stroke. In addition, this can be achieved in a hardware configuration including an existing internal-combustion engine and peripheral devices and controllers thereof. Hence, this can be implemented without increasing the manufacturing cost of the internal-combustion engine.

Specifically, in a port-injection internal-combustion engine, when fuel injected, based on the stored cylinder-determining information, toward the predetermined cylinder before the determination of the actual stroke is determined not to be fuel introduced into the cylinder at the previous combustion timing of the fuel injected at the fuel injection timing after the determination of the actual stroke of the predetermined cylinder, fuel is not reinjected at the first fuel injection timing after the determination of the actual stroke of the predetermined cylinder. Consequently, this can prevent deterioration of emission characteristics due to excessively rich combustion caused by the fuel reinjection at the first fuel injection timing after the determination of the actual stroke in a conventional technique. In contrast, in the port-injection internal-combustion engine, when fuel injected, based on the stored cylinder-determining information, toward the predetermined cylinder before the determination of the actual stroke is determined to be fuel introduced into the cylinder at the determination of the actual stroke of the predetermined cylinder, fuel is reinjected at the first fuel injection timing after the determination of the actual stroke. Consequently, this can prevent misfire or deterioration of emission characteristics due to excessively lean combustion caused by a decreased injection volume in the conventional technique.

The fifth aspect of the present invention provides, in addition to elements of the first aspect, the internal-combustion engine controller, wherein the internal-combustion engine is a direct-injection internal-combustion engine whose fuel injection valve is disposed toward a combustion chamber; and the injection timing-determining unit determines whether or not the fuel injected toward the predetermined cylinder based on the stored cylinder-determining information and the fuel to be injected at the first fuel injection timing after the determination of the actual stroke of the predetermined cylinder are combined at the same combustion timing, by determining whether or not a stroke at the determination of the actual stroke of the predetermined cylinder is before top dead center during an exhaust stroke.

The sixth aspect of the present invention provides, in addition to elements of the second aspect, the internal-combustion engine controller, wherein the internal-combustion engine is a direct-injection internal-combustion engine whose fuel injection valve is disposed toward a combustion chamber; and the injection timing-determining unit determines whether or not the fuel injected toward the predetermined cylinder based on the stored cylinder-determining information and the fuel to be injected at the first fuel injection timing after the determination of the actual stroke of the predetermined cylinder are combined at the same combustion timing, by determining whether or not a stroke at the determination of the actual stroke of the predetermined cylinder is before top dead center during an exhaust stroke.

According to the fifth and sixth aspects of the present invention, it is determined in a direct-injection internal-combustion engine whether or not a stroke at the determination of the actual stroke of the cylinder having an injection based on stored cylinder-determining information before the determination of the actual stroke is before top dead center during an exhaust stroke. Depending on this determination, it is determined whether or not the fuel to be injected at the first fuel injection timing after the determination of the actual stroke is combined at the same combustion timing. Thus, the resulting fuel combustion state can be definitely identified in respect to the fuel which has been injected before the determination of the actual stroke. In addition, this can be achieved in a hardware configuration including an existing internal-combustion engine and peripheral devices and controllers thereof. Hence, this can be implemented without increasing the manufacturing cost of the internal-combustion engine.

Specifically, in a direct-injection internal-combustion engine, when fuel injected, based on the stored cylinder-determining information, toward the predetermined cylinder before the determination of the actual stroke is determined to be neither combusted in the cylinder nor exhausted outside the cylinder before the combustion timing of the fuel to be injected at the fuel injection timing after the determination of the actual stroke of the predetermined cylinder, fuel is not reinjected at the first fuel injection timing after the determination of the actual stroke. Consequently, this can prevent deterioration of emission characteristics due to excessively rich combustion caused by the fuel reinjection at the first fuel injection timing after the determination of the actual stroke in a conventional technique. In contrast, in the direct-injection internal-combustion engine, when fuel injected, based on the stored cylinder-determining information, toward the predetermined cylinder before the determination of the actual stroke is determined to be combusted in the cylinder or exhausted outside the cylinder at the determination of the actual stroke of the predetermined cylinder, fuel is reinjected at the first fuel injection timing after the determination of the actual stroke. Consequently, this can prevent misfire or deterioration of emission characteristics due to excessively lean combustion caused by a decreased injection volume in the conventional technique.

Advantageous Effects of Invention

Embodiments of the present invention can provide internal-combustion engine controllers capable of improving emission characteristics at the time of starting an internal-combustion engine.

BRIEF DESCRIPTION OF DRAWINGS

FIG. 12(*a*) illustrates a normal driving condition. FIG. 12(*b*) illustrates how to correct a finished fuel injection flag in Example 1 which represents storage of incorrect crank angle at the time of stating the engine.

FIG. 13(*a*) illustrates a normal driving condition. FIG. 13(*b*) illustrates how to correct a finished fuel injection flag in Example 2 which represents storage of incorrect crank angle at the time of stating the engine.

FIG. 14(*a*) illustrates a normal driving condition. FIG. 14(*b*) illustrates how to correct a finished fuel injection flag in Example 3 which represents storage of incorrect crank angle at the time of stating the engine.

FIG. 19(*a*) illustrates a normal driving condition. FIG. 19(*b*) illustrates how to correct a finished fuel injection flag in Example 1 which represents storage of incorrect crank angle at the time of stating the engine.

FIG. 20(*a*) illustrates a normal driving condition. FIG. 20(*b*) illustrates how to correct a finished fuel injection flag in Example 2 which represents storage of incorrect crank angle at the time of stating the engine.

DESCRIPTION OF EMBODIMENTS

First Embodiment

Figure 1:
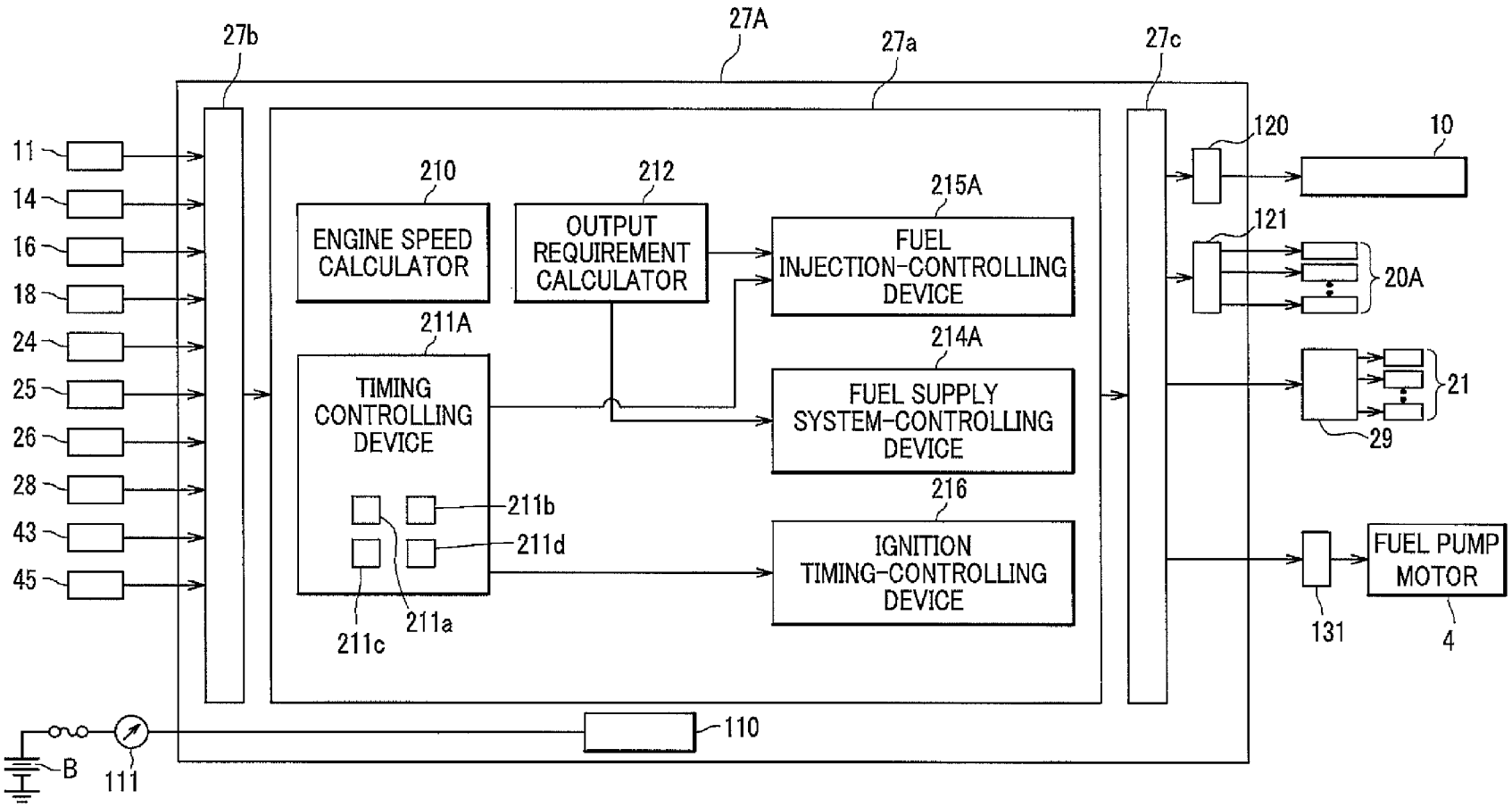
FIG. 1 is a block diagram illustrating an engine controller ECU of the first embodiment.

Hereinafter, briefly described is a prototype internal-combustion engine having an internal-combustion engine controller according to the first embodiment of the present invention.

(Overview of Internal-Combustion Engine)

An internal-combustion engine (port-injection internal-combustion engine) includes, for example, a 4-cylinder direct-injection engine main unit (not shown). An intake pipe of the engine main unit has an intake air temperature sensor 11 (see FIG. 1), which detects a temperature of intake air, and an air flow meter 14 (See FIG. 1), which detects an intake air volume, namely a flow rate of the intake air. A throttle valve (not shown) whose position is controlled by a throttle valve driving motor 10 (see FIG. 1) and a throttle position sensor 16 (see FIG. 1) which detects the throttle position are disposed downstream of the air flow meter 14 of this intake pipe.

In addition, downstream of the throttle valve of the intake pipe, a surge tank (not shown) is disposed. This surge tank has an intake air pressure sensor 18 (see FIG. 1) that detect an intake pressure (also referred to as "intake manifold pressure"). Further, between the surge tank and cylinder heads of the engine main unit, an intake manifold is disposed so as to feed air to each cylinder of the engine main unit. Also, a cylinder head of the engine main unit is installed with an intake valve, an exhaust valve, a fuel injection valve 20A (see FIG. 1) that injects fuel into an intake port of each cylinder, and a spark plug 21 (see FIG. 1). Each spark plug 21 ignites an air-fuel mixture in a combustion chamber by using spark discharge by means of a distributor 29.

As used herein, examples of the distributor 29 include an electronic distributor.

Meanwhile, an exhaust pipe (not shown) of the engine main unit is installed with a catalytic module (not shown) including catalysts such as a three-way catalyst that can purify CO, HC, and $NO_x$ from exhaust gas. Upstream of this catalytic module, there is provided an exhaust gas sensor (e.g., an air-fuel ratio sensor, an oxygen sensor) 24 (see FIG. 1) that detects an air-fuel ratio or lean/rich condition of the exhaust gas.

Also, a cylinder block of the engine main unit is installed with a water temperature sensor 25 (see FIG. 1) that detects a coolant temperature and a crank sensor 26 (see FIG. 1) that generates a pulse signal when the crankshaft of the engine main unit rotates to a certain crank angle, for example, every 6 degrees. In addition, a camshaft (not shown) is provided with a TDC (Top Dead Center) sensor 28 (see FIG. 1), which outputs a TDC pulse at each time the piston of each cylinder reaches a crank angle corresponding to top dead center. Based on output signals of these crank sensor 26 and TDC sensor 28, a crank angle is calculated by an engine controller ECU (Electric Control Unit) 27A (see FIG. 1). Also, an engine speed Ne is calculated based on the output signal of the crank sensor 26.

As used herein, the engine controller ECU 27A corresponds to an "internal-combustion engine controller" set forth in the appended Claims.

(Fuel Supply System)

The following briefly describes a fuel supply system of the internal-combustion engine.

In the internal-combustion engine, fuel is supplied from a fuel tank (not shown) to a delivery pipe (not shown) by means of a fuel pump motor 4 (see FIG. 1)-integrated fuel pump via a feed pipe (not shown). The fuel is supplied from the delivery pipe via four fuel pipes (not shown) to fuel injection valves 20A (see FIG. 1) disposed in intake ports of respective cylinders.

In this connection, this embodiment uses a below-described fuel injection-controlling device (fuel injection-controlling unit) 215A, which functions to run a CPU of the engine controller ECU 27A, to control the fuel injection valve 20A so as to perform an injection during, for example, an exhaust stroke.

A switch circuit 131 (see FIG. 1) that is controlled by the engine controller ECU 27A turns on or off the fuel pump motor 4 of the fuel pump.

<<Functions of Engine Controller ECU>>

By referring to FIG. 1, functions of the engine controller ECU are outlined. FIG. 1 is a block diagram illustrating an engine controller ECU of the first embodiment.

The engine controller ECU 27A receives outputs from, for example, sensors 11, 14, 16, 18, 24, 25, 26, and 28, an accelerator position sensor 43 that detects a stepping amount of an accelerator pedal, and a vehicle speed sensor 45 that outputs a vehicle speed by detecting a wheel speed etc.

This engine controller ECU 27A primarily includes a microcomputer 27*a*. The microcomputer 27*a* includes, for example, a CPU (Central Processing Unit) (not shown), a ROM (Read Only Memory), a RAM (Random Access Memory), a high-speed nonvolatile memory, an input interface circuit 27*b*, and an output interface circuit 27*c*.

This microcomputer 27*a*, for example, allows the CPU to execute a program stored in the ROM to control, depending on a stepping amount of the accelerator pedal manipulated by a driver and on a driving condition of the engine, a position of the throttle valve (not shown), an amount of fuel injection through the fuel injection valve 20A, and an ignition timing of the spark plug 21.

Meanwhile, the engine controller ECU 27A is powered by battery B and includes an ECU source circuit 110 that supplies power to, for example, the microcomputer 27*a* in the engine controller ECU 27A, a driver circuit 120 that drives the throttle valve driving motor 10 controlling a position of the throttle valve, and a driver circuit 121 that operates the fuel injection valves 20A.

An ignition switch 111 (hereinafter, referred to as an "IG-SW 111") turns on the ECU source circuit 110. This turns on power supply to an ignitor (not shown) that generates and feeds high voltage to the distributor 29.

The microcomputer 27*a* includes, for example, an engine speed calculator 210, a timing controlling device 211A, an output requirement calculator 212, a fuel supply system-controlling device 214A, a fuel injection-controlling device 215A, and an ignition timing-controlling device 216, all of which are functional units to achieve an objective by reading and executing a program stored in the ROM.

(Engine Speed Calculator)

In order to regulate a whole engine controller, the timing controlling device 211A detects an operation position signal of the IG-SW 111 and sets an operation position detection flag, FLAGIGSW, corresponding to the operation position signal. In addition, the engine speed calculator 210 calculates an engine speed Ne based on a signal from the crank sensor 26 and sends a signal to an output requirement calculator 212, a fuel supply system-controlling device 214A, and an ignition timing-controlling device 216.

(Timing Controlling Device)

The timing controlling device 211A reads a signal from the crank sensor 26 (hereinafter, referred to as a "CRK pulse") and a signal from the TDC sensor 28 (hereinafter, referred to as a "TDC pulse"), and detects, based on these signals, a TDC timing of starting an intake stroke of each cylinder as a reference crank angle (=0 (zero) degrees). Whenever a new CRK pulse is received, 6 degrees, for example, are subtracted from the reference crank angle, 0 (zero) degrees, to calculate a present crank angle of each cylinder. Then, the crank angles are stored in crank angle storage devices 211*a*, 211*b*, 211*c*, and 211*d*.

Note that when the crank angle reaches −180 degree, the crank angle is read as 540 degrees. Then, the crank angle continues to be subjected to subtraction each time a new CRK pulse is received.

Specifically, these crank angle storage devices 211*a*, 211*b*, 211*c*, and 211*d* each include a high-speed nonvolatile memory. As used herein, the crank angle storage devices 211*a*, 211*b*, 211*c*, and 211*d* correspond to a "cylinder-determining information storing unit" set forth in the appended Claims.

Figure 2:
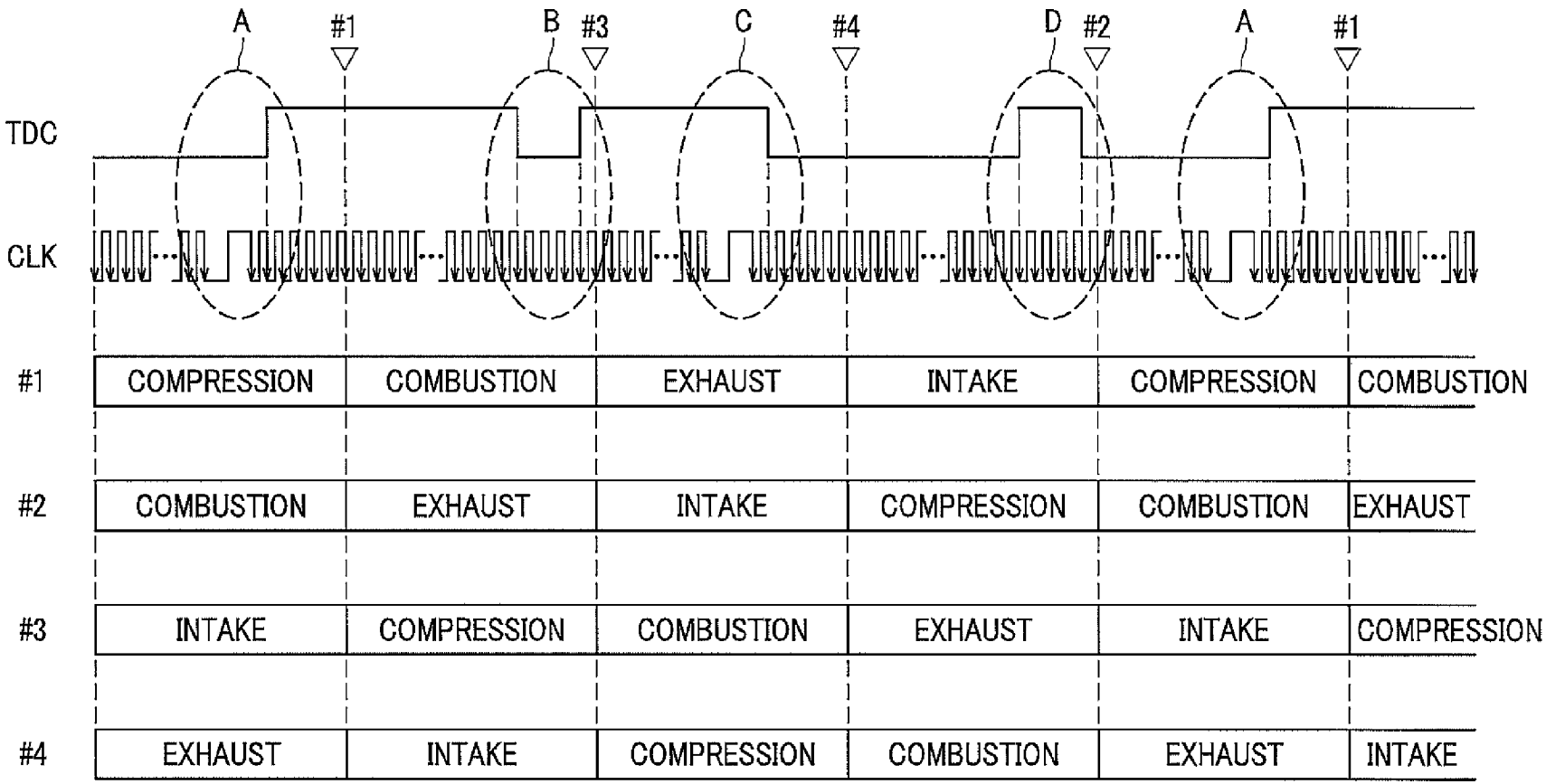
FIG. 2 is a time chart showing a TDC pulse, a CRK pulse, and strokes of each cylinder.

FIG. 2 is a time chart showing a TDC pulse, a CRK pulse, and strokes of each cylinder.

In this embodiment, the timing controlling device 211A determines which cylinder is at TDC of an exhaust stroke as follows: portions of each time chart regarding the TDC pulse designated as "TDC" at the top item of FIG. 2 and the CRK pulse designated as "CRK" at the second item from the top indicate A, B, C, and D; these portions correspond to periods of predetermined BTDC (Before TDC) angles; and the timing controlling device 211A determines which combination between the CRK and TDC pulse shapes has been input during the periods.

In an example of the combinations between the CRK and TDC pulse shapes as shown in FIG. 2, the combinations between the CRK and TDC pulse shapes differ from each other for the TDC timing of each exhaust stroke of four cylinders. The timing controlling device 211A detects the TDC timing of the exhaust stroke of one cylinder, thereby capable of determining which cylinder enters an intake stroke and calculating a present crank angle of each cylinder with respect to the above reference crank angle 0.

By the way, the combination of an inverted triangle symbol "7" and a symbol "#N" (N=1 to 4) in FIG. 2 denotes which cylinder enters a combustion stroke at the timing designated as the symbol "7".

Hereinafter, in this embodiment, four strokes constituting one combustion cycle of each cylinder of an internal-combustion engine are referred to as an "intake stroke", a "compression stroke", a "combustion stroke", and an "exhaust stroke".

Note that the "intake stroke" is also called an "air intake stroke" and the "combustion stroke" is also called an "expansion stroke".

Meanwhile, in the engine controller ECU 27A, when the IG-SW 111 is turned to the ON position for ignition, the microcomputer 27*a* is booted to initiate an initializing process. In addition, when the IG-SW 111 is turned to a starter drive position, a starter starts rotating the engine. When the microcomputer 27*a* completes the initializing process, the timing controlling device 211A starts reading a CRK pulse from the crank sensor 26 and a TDC pulse from the TDC sensor 28 periodically. Immediately after completion of the initializing process, the timing controlling device 211A calculates a crank angle of each cylinder as follows: crank angles stored in the crank angle storage devices 211*a*, 211*b*, 211*c*, and 211*d* at the time of the last stoppage of the engine are used; and 6 degrees are subtracted at each CRK pulse detection from the stored crank angle to yield a crank angle of each cylinder. The crank angle as so calculated is referred to as a "memory-based crank angle" or "first unit-based crank angle".

Then, after the completion of the initializing process by the microcomputer 27*a*, the timing controlling device 211A determines whether or not, at the timing of detecting the first TDC pulse, the memory-based crank angle is the same as the crank angle of each cylinder that has been determined based on the combination between CRK and TDC pulse shapes. When these angles are the same, the crank angle of each cylinder remains the same, and is updated and newly stored in the crank angle storage devices 211*a*, 211*b*, 211*c*, and 211*d*. Hereinafter, the crank angle of each cylinder that has been determined based on the combination between the CRK and TDC pulse shapes is referred to as a "hardware-based crank angle" or "second unit-based crank angle".

The reasons why the memory-based crank angle does not match with the hardware-based crank angle can include movement of the crankshaft before booting or during stoppage of the engine controller ECU 27A. Specific examples include the case where the starter operates before booting the engine controller ECU 27A at the time of starting the engine, the case where the crankshaft is made to move during its repair at a service shop, the case where a vehicle moves on a slope while a tire is connected to the engine (i.e., gear in condition), and other cases. When the memory-based crank angle fails to match with the hardware-based crank angle, a difference between the crank angles of each cylinder is corrected. Then, 6 degrees are subtracted from the corrected crank angle at each CRK pulse detection to update the crank angle of each cylinder. Then, the resulting crank angles are stored in the crank angle storage devices 211*a*, 211*b*, 211*c*, and 211*d*.

As illustrated in portions A and C in FIG. 2, when the crank pulse is detected as a pulse with a wider interval than a reference pulse with 6 degrees, the timing controlling device 211A easily determines the wide pulse because the CRK pulse has a different interval before and after the wide pulse. For example, one cycle of the wide pulse corresponds to 18 degrees. Thus, the crank angle is calculated as equivalent to three 6-degree pulses.

In addition, the timing controlling device 211A outputs the received crank angle signal to the fuel injection-controlling device 215A whenever the crank angle is calculated at every 6 degrees.

At the initial period of starting the engine, the timing controlling device 211A outputs a memory-based crank angle to the fuel injection-controlling device 215A and the ignition timing-controlling device 216. Then, this memory-based crank angle is checked by a hardware-based crank angle. When there is a difference between the memory-based crank angle and the hardware-based crank angle, the memory-based crank angle is determined to be incorrect. At that time, the memory-based crank angle is corrected to the hardware-based crank angle. Then, the corrected crank angle is output to the fuel injection-controlling device 215A and the ignition timing-controlling device 216.

(Output Requirement Calculator)

The output requirement calculator 212 is primarily based on a signal from the accelerator position sensor 43, a signal from the vehicle speed sensor 45, and an engine speed Ne calculated by the engine speed calculator 210 to estimate a reducing transmission gear, to estimate a present engine output torque, to calculate a torque requirement, to accordingly calculate an intake volume, and to control a position of the throttle valve (not shown) by using the throttle valve driving motor 10. The present engine output torque estimated by the output requirement calculator 212 is sent to the fuel supply system-controlling device 214A and the fuel injection-controlling device 215A.

Note that an intake volume corresponding to the torque requirement estimated by the output requirement calculator 212 is calculated using, for example, an engine coolant temperature detected by a water temperature sensor 25, a throttle position detected by a throttle position sensor 16, an intake air temperature detected by an intake air temperature sensor 11, an intake flow rate detected by an air flow meter 14, and an intake air pressure detected by an intake air pressure sensor 18.

As used herein, the "driving condition" set forth in the appended Claims refers to an engine speed Ne, a vehicle speed, a present estimated torque and torque requirement calculated by the output requirement calculator 212, and a signal from the accelerator position sensor 43. The "driving condition-detecting unit" to detect the "driving condition" includes, for example, the crank sensor 26, the accelerator position sensor 43, the vehicle speed sensor 45, the engine speed calculator 210, and the output requirement calculator 212.

(Fuel Supply System-Controlling Device)

The fuel supply system-controlling device 214A controls a fuel pump motor 4.

(Fuel Injection-Controlling Device)

The fuel injection-controlling device 215A sets an amount of fuel injection, specifically a fuel injection period, depending on the engine speed Ne and the torque requirement calculated by the output requirement calculator 212. Based on a timing map (not shown) regarding a predetermined injection initiation according to a signal of a crank angle of each cylinder from the timing controlling device 211A, the fuel injection-controlling device 215A controls the fuel injection valve 20A of each cylinder to inject fuel.

The fuel injection-controlling device 215A regulates an amount of fuel injection based on a signal, corresponding to an oxygen level in exhaust gas, from the exhaust gas sensor 24. This makes it possible to adjust the combustion state that conforms to the exhaust gas regulations.

(Ignition Timing-Controlling Device)

The ignition timing-controlling device 216 is based on an engine speed Ne and a signal of the above crank angle of each cylinder from the timing controlling device 211A to control an ignition timing in view of output torque control and exhaust gas control. A procedure for controlling this ignition timing is a known technique. Thus, the detailed description is omitted.

<<Overall Flow Chart Regarding Fuel Injection Control>>

Figure 3:
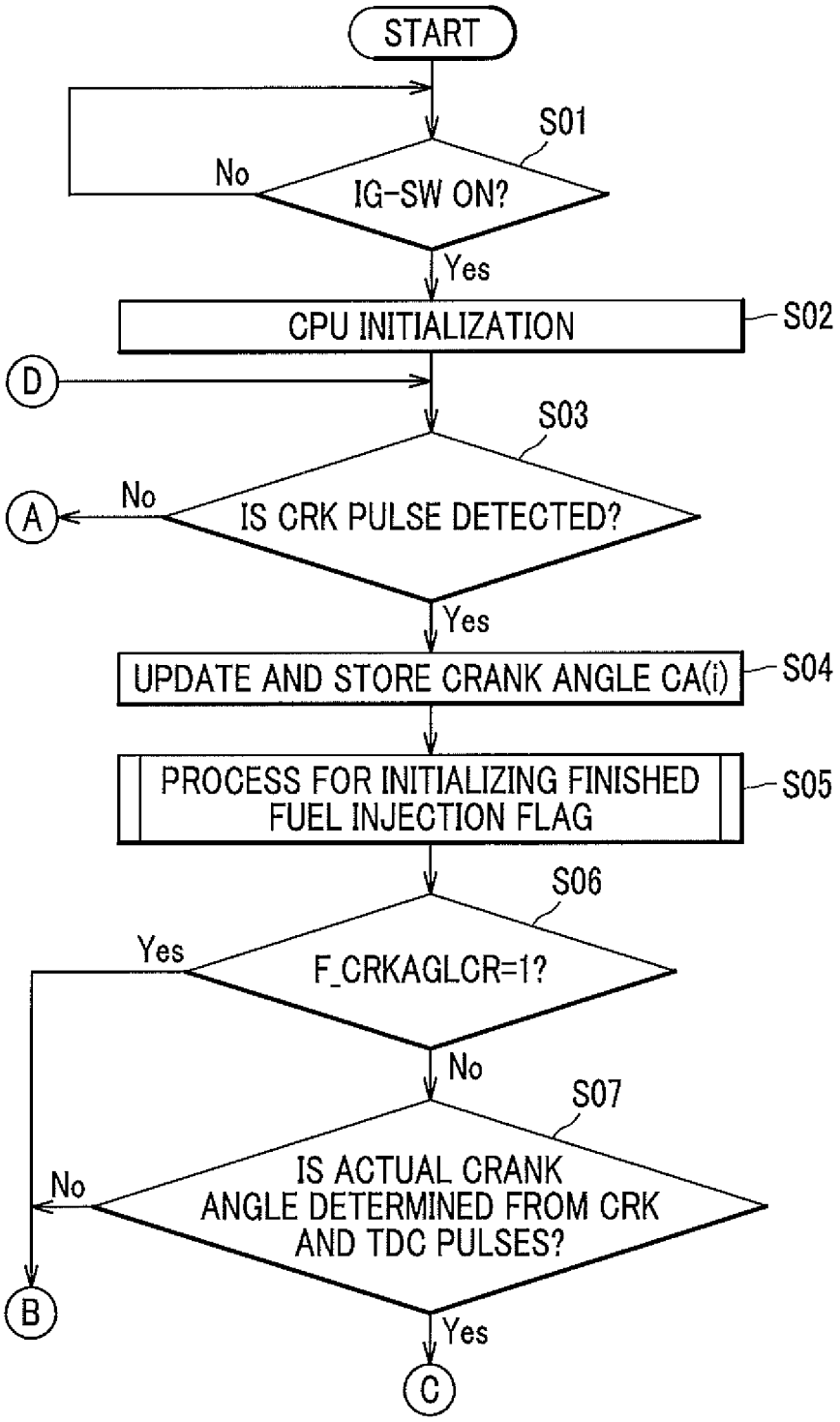
FIG. 3 is an overall flow chart illustrating a flow of fuel injection control in an engine controller ECU from the time of starting an engine to the time of its stoppage.
Figure 4:
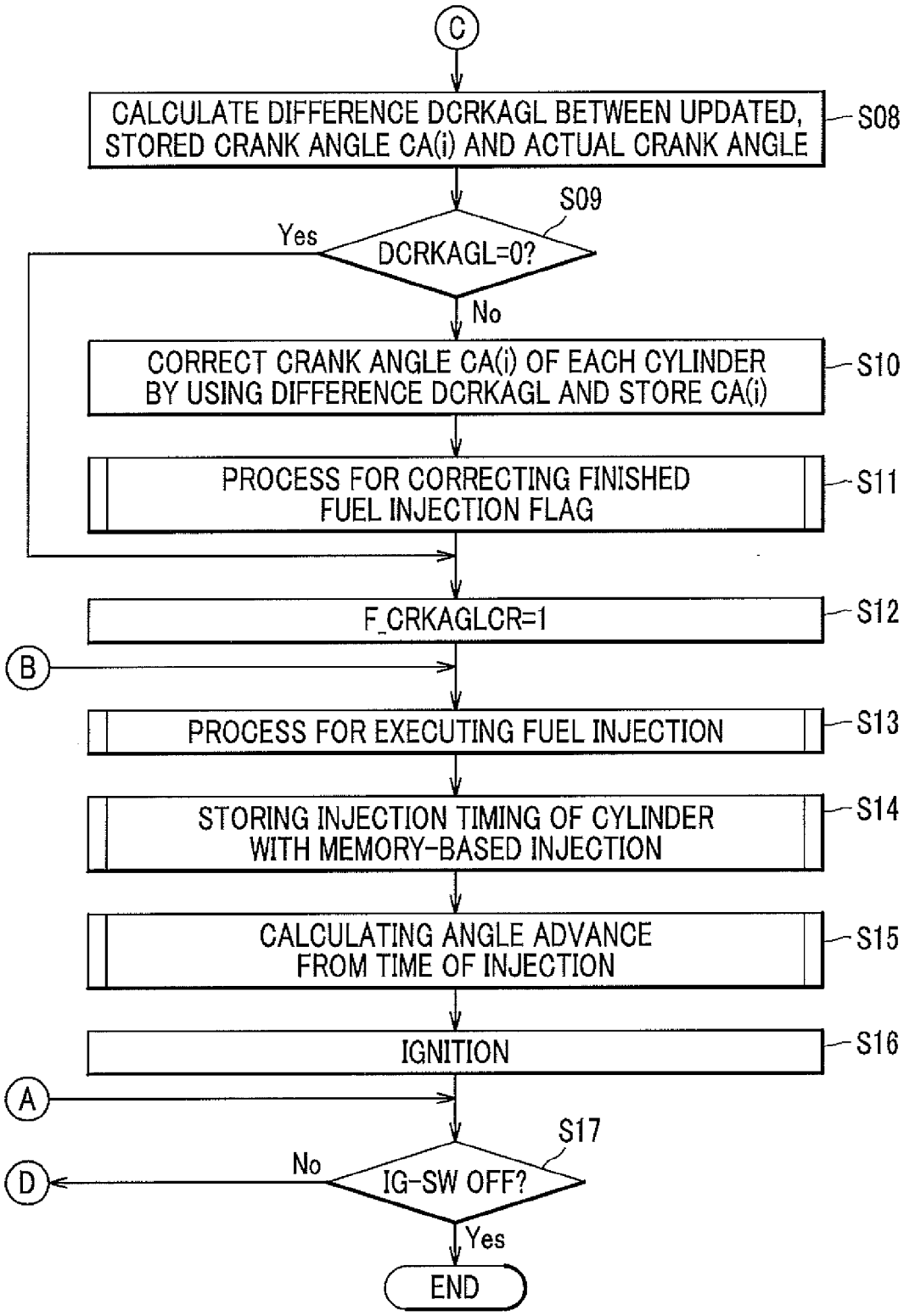
FIG. 4 is an overall flow chart illustrating a flow of fuel injection control in an engine controller ECU from the time of starting an engine to the time of its stoppage.

Next, by referring to FIGS. 3 and 4, fuel injection control in the CPU of the microcomputer 27*a* of the engine controller ECU 27A is outlined at the times of engine start, normal driving, and stoppage. FIGS. 3 and 4 are overall flow charts illustrating a flow of fuel injection control in the engine controller ECU from the time of engine start to its stoppage.

As used herein, at the "START", a driver operates the IG-SW 111 to boot the microcomputer 27*a* of the engine controller ECU 27A. At step S01, an IG-SW 111 operation position detection flag is set to "FLAGIGSW=1" (not shown), by which is meant ignition ON.

At step S02, the CPU starts an initializing process. During the process, a "process for initializing a flag involved in the first fuel injection" is executed in the timing controlling device 211A and the fuel injection-controlling device 215A. Specifically, the following flags and data, for example, are reset.

The fuel injection-controlling device 215A resets the first fuel injection flag, F_FIRSTINJ(i) (F_FIRSTINJ(i)=0, i=1 to N), which represents that the first fuel injection has been carried out for each cylinder at the time of starting the engine. As used herein, the letter "i" denotes an argument indicating the cylinder number among N (in this embodiment, N=4) cylinders.

In addition, the fuel injection-controlling device 215A resets F_FIRSTINJSET (i) (F_FIRSTINJSET(i)=0, i=1 to N), a frag indicating that the first fuel injection timing has been stored (memorized), that is, indicating that the crank angle at the above first fuel injection has been stored.

Further, the timing controlling device 211A: corrects the crank angle after determination of an actual stroke; resets F_CRKAGLCR (F_CRKAGLCR=0), a flag indicating that a finished fuel injection flag for controlling the next fuel injection following the first fuel injection has been corrected depending on the need; and resets CYLJUDAGL(i) (CYLJUDAGL(i)=0, i=1 to N), a crank angle advance from the first fuel injection based on the stored crank angle CA (i) to the determination of the actual stroke.

Immediately after completion of a process for initializing the CPU of the microcomputer 27*a* at step S02, that is, immediately after completion of booting the engine ECU 27A, the timing controlling device 211A reads CRK and TDC pulses. This reading of the CRK and TDC pulses is repeated at each CRK pulse input or with a constant pulse interval.

Then, at step S03, the timing controlling device 211A checks whether or not the CRK pulse has been detected. When the CRK pulse has been detected (Yes), go to step S04. When the CRK pulse has not been detected (No), follow inconnector (A) and go to step S17 in FIG. 4. At step S04, the timing controlling device 211A makes a crank angle CA(i) of each cylinder updated and stored at every CRK pulse detection in the crank angle storage devices 211*a*, 211*b*, 211*c*, and 211*d*. Specifically, the timing controlling device 211A reads, at each CRK pulse reading, a crank angle stored in the crank angle storage devices 211*a*, 211*b*, 211*c*, and 211*d*, and subtracts, for example, 6 degrees from the read crank angle CA (i). The resulting value is made to be stored as a new crank angle CA(i). As used herein, the letter "i" denotes an argument indicating the cylinder number among N (in this embodiment, N=4) cylinders.

Note that when the new crank angle CA(i) from which 6 degrees have been subtracted is −180 degrees, the crank angle CA(i) is read as 540 degrees and is stored in the crank angle storage devices 211*a*, 211*b*, 211*c*, and 211*d*.

At step S05, the fuel injection-controlling device 215A initializes a finished fuel injection flag at each CRK pulse detection. The detailed flow chart in FIG. 6 below describes this process for initializing a finished fuel injection flag.

At step S06, the timing controlling device 211A checks whether or not a flag F_CRKAGLCR=1. If the flag F_CRKAGLCR=1 (Yes), follow inconnector (B) and go to step S13 in FIG. 4. If the flag F_CRKAGLCR≠1 (No), go to step S07.

At step S07, the timing controlling device 211A checks whether or not an actual crank angle is determined from the CRK and TDC pulses. Specifically, a combination between CRK and TDC pulse shapes is used to check whether or not the actual crank angle of each cylinder has been determined. If the actual crank angle has been determined from the CRK and TDC pulses (Yes), follow inconnector (C) and go to step S08 in FIG. 4. If the actual crank angle has not been determined (No), follow inconnector (B) and go to step S13 in FIG. 4.

By the way, the combination between the CRK and TDC pulse shapes uniquely determines the actual crank angle of each cylinder.

At step S08, the timing controlling device 211A calculates a difference, DCRKAGL (0 to 720 degrees), between the crank angle CA(i) updated and stored at step S04 in the flow chart of FIG. 3 and the actual crank angle determined in step S07.

At step S09, the timing controlling device 211A checks whether or not the difference DCRKAGL=0. If the difference DCRKAGL=0 (Yes), go to step S12. If the difference DCRKAGL≠0 (No), go to step S10.

At step S10, the timing controlling device 211A corrects the crank angle CA(i) of each cylinder by using the difference DCRKAGL, and stores (memorizes) the resulting angle in the crank angle storage devices 211*a*, 211*b*, 211*c*, and 211*d*.

At step S11, the fuel injection-controlling device 215A corrects the finished fuel injection flag that has been set in the past control cycle during the execution of the fuel injection control of the process in step S13 as described below. The detailed flow chart of FIG. 10 below describes a detailed process of this step S11.

Then, at step S12, the timing controlling device 211A set a flag F_CRKAGLCR ("F_CRKAGLCR=1"), indicating that the crank angle CA (i) has been corrected depending on the need by using a "hardware-based crank angle" and that the finished fuel injection flag has been corrected.

At step S13, the fuel injection-controlling device 215A carries out a process for executing a fuel injection. The detailed flow chart of FIG. 7 below describes a detailed process of this step S13.

At step S14, the fuel injection-controlling device 215A stores the fuel injection timing of the cylinder of which fuel injection has been performed according to the memory-based crank angle CA(i) ("STORING INJECTION TIMING OF CYLINDER WITH MEMORY-BASED INJECTION"). The detailed flow chart of FIG. 8 below describes a detailed process of this step S14.

At step S15, the fuel injection-controlling device 215A calculates a crank angle advance (i.e., "CALCULATING ANGLE ADVANCE FROM TIME OF INJECTION") from the time of injecting, based on the memory-based crank angle, fuel toward the cylinder to the actual stroke determination (i.e., the completion of checking the "hardware-based crank angle"). The detailed flow chart of FIG. 9 below describes a detailed process of this step S15.

At step S16, the ignition timing-controlling device 216 ignites fuel in each cylinder ("IGNITION") at the time of detecting a predetermined crank angle according to the crank angle CA(i) input from the timing controlling device 211A.

At step S17, the timing controlling device 211A checks whether or not the IG-SW 111 is turned to the operation position to stop the engine. That is, whether or not the IG-SW 111 is turned off is checked ("IG-SW OFF?"). This is checked in a predetermined cycle from immediately after booting the engine ECU 27A. If the IG-SW 111 has been turned off (Yes), the fuel supply system-controlling device 214A, the fuel injection-controlling device 215A, and the ignition timing-controlling device 216 perform the engine stop control. The timing controlling device 211A starts a procedure for stopping a series of the engine control. If the IG-SW 111 has not been turned off (No), follow inconnector (D) and return to step S03 of FIG. 3.

Here, until step S07 becomes Yes by determining the actual crank angle, steps S08 to S12 are skipped. Basically, steps S03 to S07 proceed, followed by steps S13 to S17. Then, the step returns to step S03. This cycle is repeated. During this cycle, at step S14, the injection timing of the cylinder with the memory-based injection is stored. Then, the angle advance from the time of the injection is calculated.

When at step S07, the actual crank angle is determined to be Yes, the process passes through steps S08 to S12 only once. In the next cycle of the overall flow chart encompassing FIGS. 3 and 4, step S06 becomes Yes. Thus, the process fails to pass through steps S08 to S12 again.

Hence, when step S07 becomes Yes by determining the actual crank angle, it may be possible to pass through steps S08 to S12 once, followed by step S13, to skip steps S14 and S15, and to proceed to step S16.

If step S17 is Yes, a procedure for stopping a series of engine control in the timing controlling device 211A is as follows; the IG-SW 111 operation position detection flag is cleared as FLAGIGSW=0, by which is meant engine stoppage; the CRK pulse is monitored to determine whether or not engine rotation is stopped; and when the engine rotation is determined to be stopped, the crank angle CA(i) of each cylinder is stored in a nonvolatile memory to complete the procedure for stopping a series of engine control.

As described above, the engine controller ECU 27A is under an operation condition for a while even if the IG-SW 111 is turned off. The timing controlling device 211A detects the CRK pulse until the stoppage of engine rotation, and updates and stores the crank angle CA(i) of each cylinder.

As used herein, the finally stored crank angle CA(i) of each cylinder at the time of stopping the engine rotation corresponds to "cylinder-determining information stored at the time of stoppage of an internal-combustion engine" set forth in the appended Claims.

Step S07 in the flow chart shown in FIG. 3 corresponds to an "actual stroke-determining unit" set forth in the appended Claims. When the TDC pulse is detected in step S07, the actual crank angle of each cylinder is determined from the combination between CRK and TDC pulse shapes. This determination timing corresponds to a timing of "the determination of the actual stroke" set forth in the appended Claims.

Figure 5A:
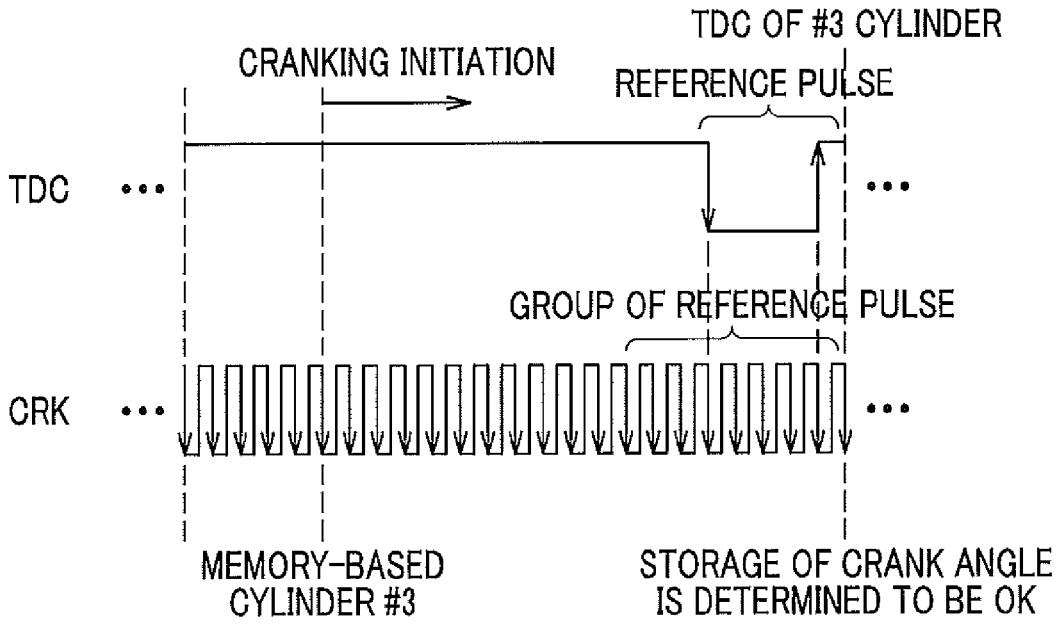
FIG. 5 illustrates how to determine an actual stroke based on TDC and CRK pulse shapes.
Figure 5B:
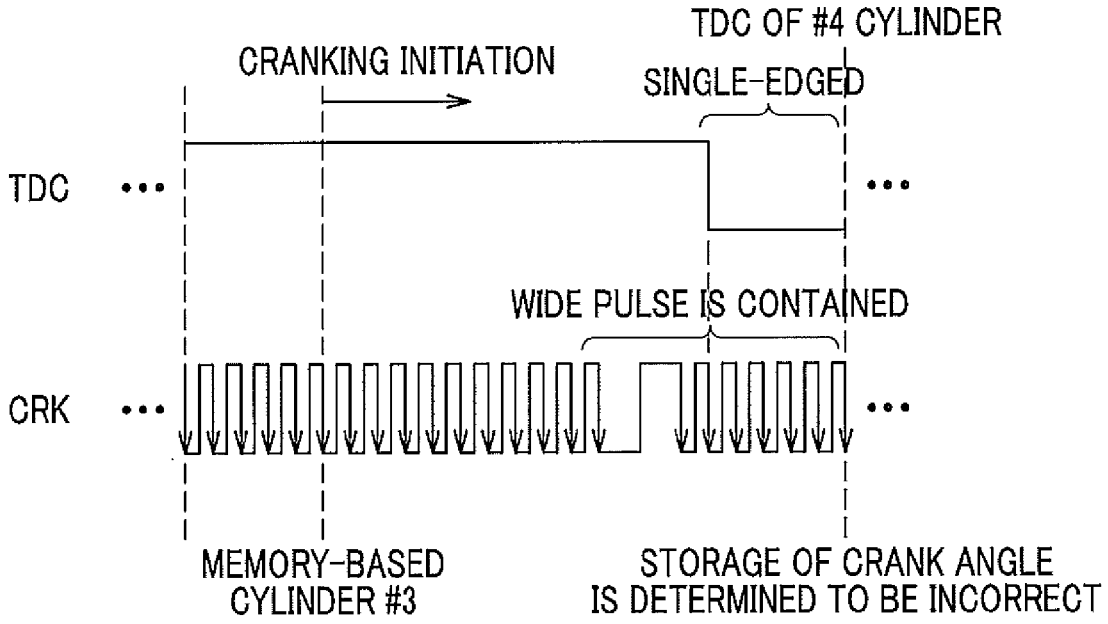

FIG. 5 is a diagram illustrating the determination of the actual stroke based on the TDC and CRK pulse shapes. In FIG. 5(*a*), the CPU of the engine controller ECU 27A recognizes a stroke according to the memory-based crank angle after starting cranking as a compression stroke of #3 cylinder, which approaches a combustion stroke (designated as "MEMORY-BASED CYLINDER #3" in FIG. 5(*a*)). In this case, from the combination between the first TDC and CRK pulse shapes after completion of booting the CPU of the engine controller ECU 27A, it is determined that the TDC pulse indicating entry of the next combustion stroke of the #3 cylinder has been detected. In this case, the present crank angle is calculated based on the crank angle stored at the time of stoppage of the engine. The cylinder in the next combustion stroke is correctly determined. Because the TDC pulse exhibits a reference pulse having a fall and a subsequent rise within a predetermined crank angle range and the CRK pulses before and after the TDC pulse consist of a group of reference pulse with 6 degrees, the #3 cylinder is going to enter the next combustion stroke as shown in portion B of FIG. 2. Thus, the cylinder in combustion is correctly determined. The crank angle storage is therefore determined to be OK.

Note that when there is a difference between the memory-based crank angle and the actual crank angle while having the correct cylinder determination, a determination indicating storage of incorrect crank angle is rendered.

In FIG. 5(*b*), the CPU of the engine controller ECU 27A recognizes a stroke according to the memory-based crank angle after starting cranking as a compression stroke of #3 cylinder, which approaches a combustion stroke (designated as "MEMORY-BASED CYLINDER #3" in FIG. 5(*b*)). In this case, from the combination between the first TDC and CRK pulse shapes after completion of booting the CPU of the engine controller ECU 27A, it is determined that the TDC pulse indicating entry of the next combustion stroke of the #4 cylinder has been detected. In this case, the actual crank angle is calculated based on the crank angle stored at the time of stoppage of the engine. The cylinder in the next combustion stroke is incorrectly determined. Because the TDC pulse exhibits only a fall, namely a single-edged pulse shape, and the CRK pulses before and after the TDC pulse contains a wide pulse with more than 6 degrees, the #4 cylinder is correctly determined to enter the next combustion stroke as shown in portion C of FIG. 2. Thus, the cylinder in combustion is incorrectly determined. The determination indicating storage of incorrect crank angle is therefore rendered.

<<Process for Initializing Finished Fuel Injection Flag>>

Figure 6:
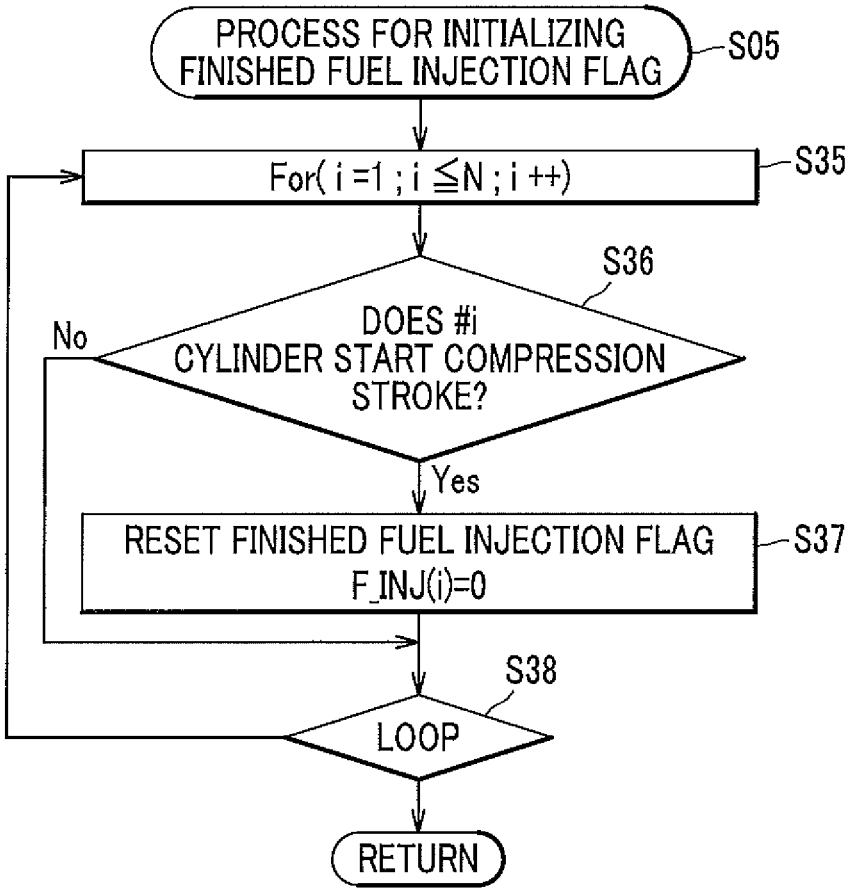
FIG. 6 is a detailed flow chart illustrating a control flow of a process for initializing a finished fuel injection flag.

Next, by referring to FIG. 6, detailed control is described regarding a "PROCESS FOR INITIALIZING FINISHED FUEL INJECTION FLAG" in step S05 of the overall flow chart shown in FIG. 3. FIG. 6 is a detailed flow chart illustrating a control flow of a process for initializing a finished fuel injection flag. The fuel injection-controlling device 215A performs this process whenever the CRK pulse input from the timing controlling device 211A is detected.

At step S35, a loop counter is described in C language, a kind of programming language. This step means starting a loop from 1 to N of the argument i.

At step S36, whether or not the initiation of #i cylinder's compression stroke is detected is determined (DOES #i CYLINDER START COMPRESSION STROKE?) from the crank angle CA(i) stored in a crank angle storage device corresponding to the #i cylinder among crank angle storage devices 211*a* to 211*d*. If the initiation of the #i cylinder's compression stroke is detected (Yes), go to step S37. Then, a finished fuel injection flag F_INJ(i) is reset ("F_INJ(i)=0"). If at step S36 the initiation of the #i cylinder's compression stroke is not detected (No), go to step S38.

Step S38 represents the lower bound of a loop range described in C language. If the above argument i is less than N, return to step S35. Then, the loop is repeated for the next argument i. If the argument i is N or more, return to the overall flow chart in FIG. 3.

In this connection, the process for initializing a finished fuel injection flag in step S05 is repeated periodically in synchronism with the CRK pulse detection during engine operation. It does not mean that once the loop from steps S35 to S38 is executed for the argument i from 1 to N, the process is permanently ended.

<<Process for Executing Fuel Injection>>

Figure 7:
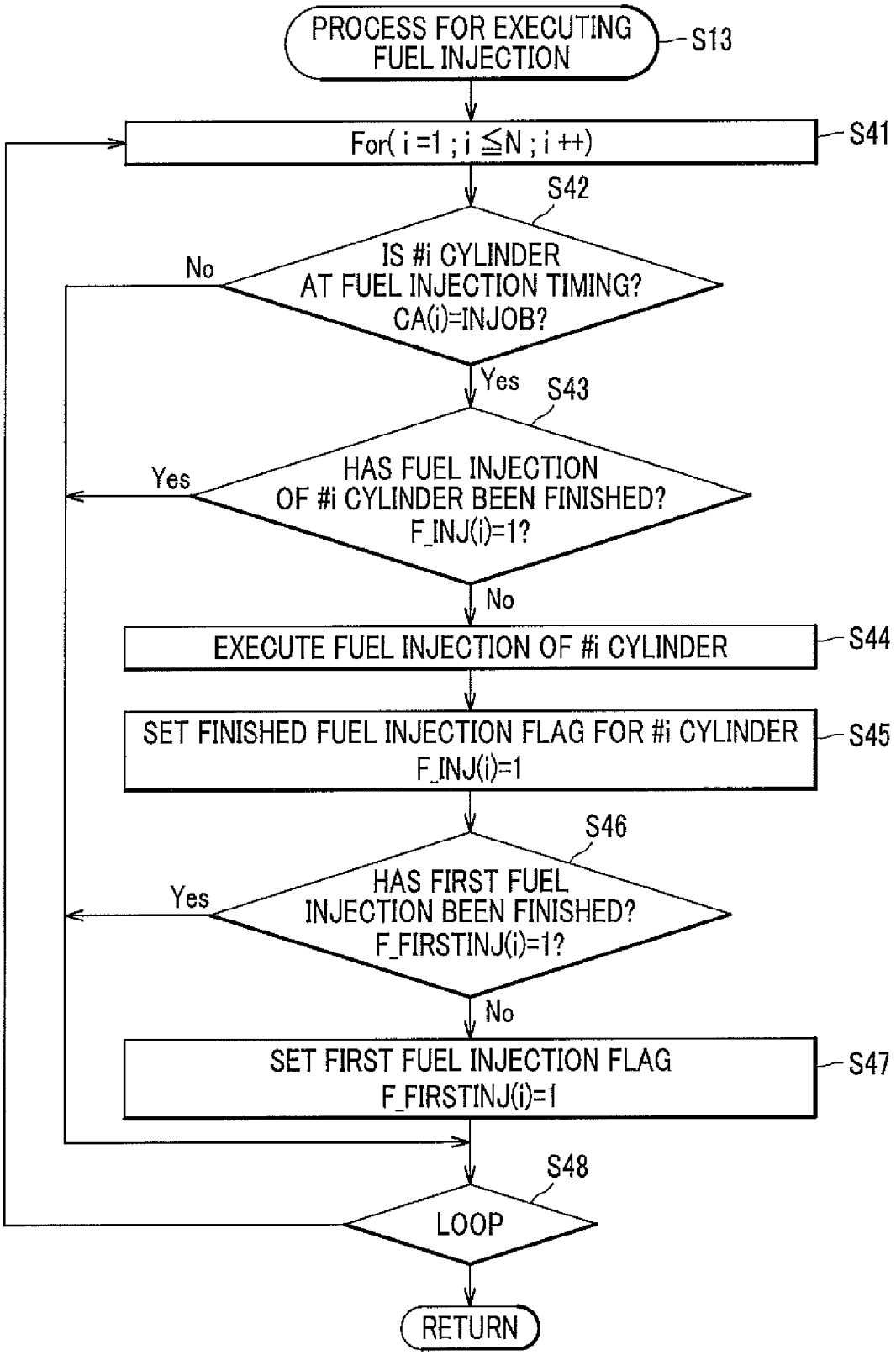
FIG. 7 is a detailed flow chart illustrating a control flow of a process for executing a fuel injection.

Next, by referring to FIG. 7, detailed control is described regarding a "PROCESS FOR EXECUTING FUEL INJECTION" in step S13 of the overall flow chart shown in FIG. 4. FIG. 7 is a detailed flow chart illustrating a control flow of a process for executing a fuel injection. This process is executed in the fuel injection-controlling device 215A.

At step S41, a loop counter is described in C language, a kind of programming language. This step means starting a loop from 1 to N of the argument i.

At step S42, whether or not the #i cylinder is at the fuel injection timing is determined ("CA(i)=INJOB?") from the crank angle CA(i) stored in a crank angle storage device corresponding to the #i cylinder among crank angle storage devices 211*a* to 211*d*. If the #i cylinder is at the fuel injection timing (Yes), go to step S43. If the #i cylinder is not at the fuel injection timing (No), go to step S48. As used herein, the term "INJOB" refers to a value of predetermined crank angle indicating a fuel injection timing. In the case of injection during an exhaust stroke, the INJOB value is set to a value from 0 to less than 180 degrees.

By the way, when the engine controller ECU 27A is booted, the fuel injection-controlling device 215A performs a fuel injection of only the #i cylinder to be first injected with fuel at the timing of receiving the first CRK pulse after starting cranking of the engine so as to promote a quick start of the engine. Fuel injection is performed regarding each of the subsequent cylinders at a predetermined fuel injection timing based on the crank angle CA(i). Specifically, in the case of injection during an exhaust stroke in such a manner as in this embodiment, fuel is injected at the timing of an exhaust stroke, for example, a crank angle of 90 degrees based on the updated, stored crank angle CA(i).

At step S43, whether or not fuel injection of the #i cylinder has been performed is check by determining whether or not the finished fuel injection flag F_INJ(i) has already been set ("F_INJ(i)=1?"). If the fuel injection of the #i cylinder has been finished (Yes), go to step S48. If the fuel injection of the #i cylinder has not been finished (No), go to step S44. At step S44, fuel is injected toward the #i cylinder. Of course, fuel injection control by the fuel injection-controlling device 215A in this step S44 defines an injection period corresponding to the torque requirement calculated by the output requirement calculator 212. In this case, the device defines an amount of fuel injection corresponding to the torque requirement at the time of starting the engine.

At step S45, the finished fuel injection flag F_INJ(i) is set ("F_INJ(i)=1") regarding the #i cylinder.

At step S46, whether or not the first fuel injection is finished is checked by determining whether or not the first fuel injection flag F_FIRSTINJ(i) has already been set ("F_FIRSTINJ(i)=1?"). If the first fuel injection has been finished (Yes), go to step S48. If the first fuel injection has not been finished (No), go to step S47.

Then, at step S47, the first fuel injection flag F_FIRSTINJ (i) is set ("F_FIRSTINJ(i)=1"). After that, go to step S48. Step S48 represents the lower bound of a loop range described in C language. If the above argument i is less than N, return to step S41. Then, the loop is repeated for the next argument i. If the argument i is N or more, return to the overall flow chart in FIG. 4.

<<Process for Storing Injection Timing of Cylinder with Memory-Based Injection>>

Figure 8:
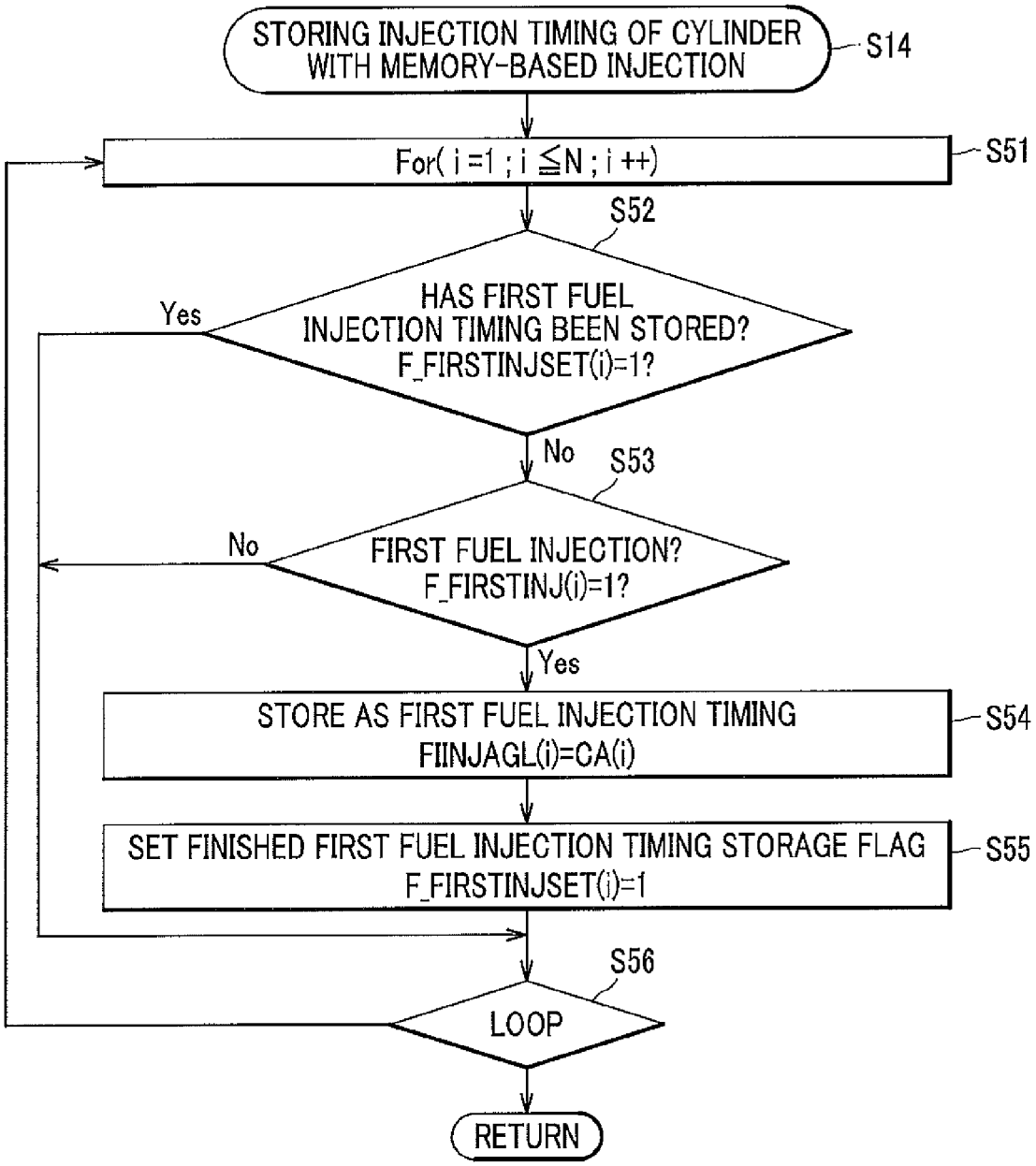
FIG. 8 is a detailed flow chart illustrating a control flow of storing a fuel injection timing of a cylinder of which a fuel injection has been performed based on a memory-based crank angle.

Next, by referring to FIG. 8, detailed control is described regarding a process for "STORING INJECTION TIMING OF CYLINDER WITH MEMORY-BASED INJECTION" in step S14 of the overall flow chart shown in FIG. 4. FIG. 8 is a detailed flow chart illustrating a control flow of storing a fuel injection timing of a cylinder of which fuel injection has been performed according to a memory-based crank angle. This process is executed in the fuel injection-controlling device 215A.

At step S51, a loop counter is described in C language, a kind of programming language. This step means starting a loop from 1 to N of the argument i. At step S52, whether or not the first fuel injection timing has been stored (memorized) is checked by determining whether or not the finished first fuel injection timing storage flag F_FIRSTINJ(i) has already been set ("F_FIRSTINJSET(i)=1?"). If the first fuel injection timing has been stored (Yes), go to step S56. If not (No), go to step S53. At step S53, whether or not the first fuel injection is carried out is checked ("F_FIRSTINJ(i)=1?"). If the first fuel injection is carried out (Yes), go to step S54. If not (No), go to step S56.

At step S54, the crank angle CA(i) at the time of this fuel injection is stored (memorized) as that at the first fuel injection timing ("STORING CRANK ANGLE AT FIRST FUEL INJECTION TIMING; FIINJAGL(i)=CA(i)").

At step S55, the finished first fuel injection timing storage flag is set ("F_FIRSTINJSET(i)=1"). Then, go to step S56.

Step S56 represents the lower bound of a loop range described in C language. If the above argument i is less than N, return to step S51. Then, the loop is repeated for the next argument i. If the argument i is N or more, return to the overall flow chart in FIG. 4.

<<Calculating Angle Advance from Time of Injection>>

Figure 9:
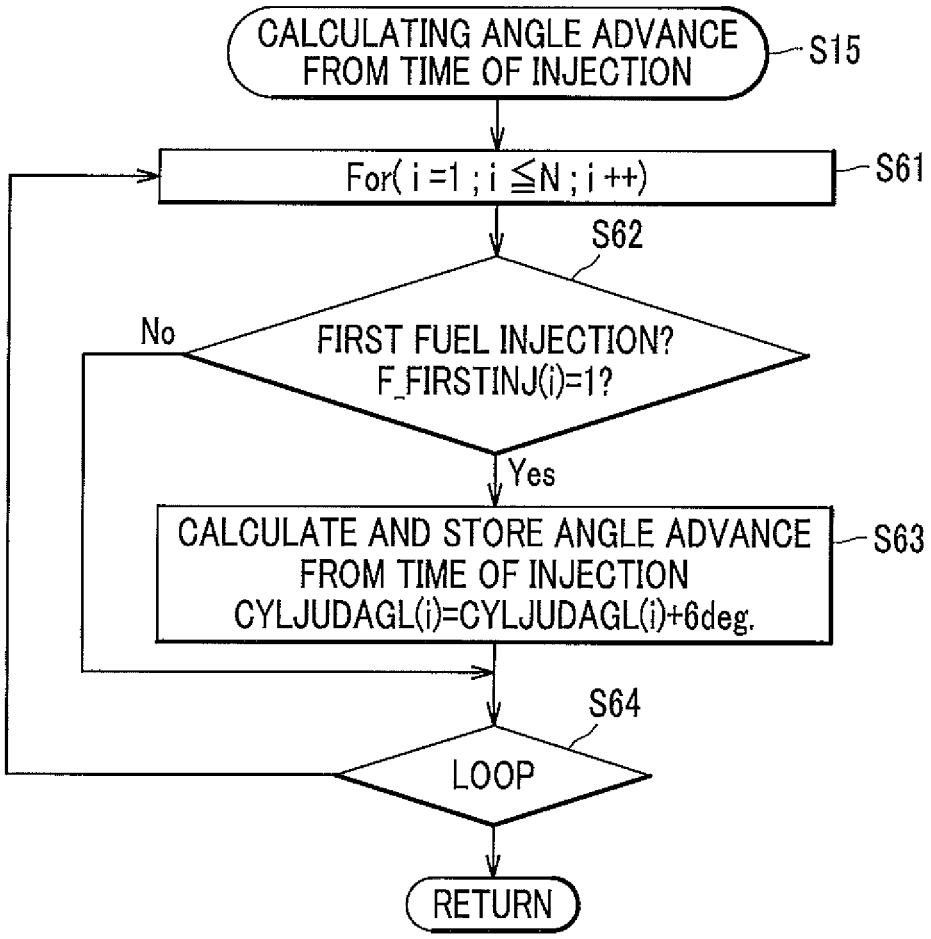
FIG. 9 is a detailed flow chart illustrating a flow of a process for calculating a crank angle which advances from the time of fuel injection to determination of an actual stroke of a cylinder of which fuel injection has been performed according to a memory-based crank angle.

Next, by referring to FIG. 9, detailed control is described regarding a process for "CALCULATING ANGLE ADVANCE FROM TIME OF INJECTION" in step S15 of the overall flow chart shown in FIG. 4. FIG. 9 is a detailed flow chart illustrating a flow of a process for calculating a crank angle which advances from the time of a fuel injection to determination of an actual stroke of a cylinder of which fuel injection has been performed according to a memory-based crank angle. This process is executed in the fuel injection-controlling device 215A.

At step S61, a loop counter is described in C language, a kind of programming language. This step means starting a loop from 1 to N of the argument i.

At step S62, whether or not the first fuel injection flag F_FIRSTINJ(i) has been set is checked ("FIRST FUEL INJECTION?; F_FIRSTINJ(i)=1?"). If the first fuel injection flag F_FIRSTINJ(i) has been set (Yes), go to step S63. If not (No), go to step S64.

At step S63, crank angles are integrated so as to calculate a crank angle CYLJUDAGL(i) which advances from the time of a fuel injection to determination of an actual stroke of a cylinder of which fuel injection has been performed according to a memory-based crank angle. Then, the resulting CYLJUDAGL(i) is stored ("CALCULATE AND STORE ANGLE ADVANCE FROM TIME OF INJECTION; CYLJUDAGL (i)=CYLJUDAGL(i)+6 degrees").

This calculation of the angle is repeated at each CRK pulse detection until step S06 in the overall flow chat in FIG. 3 becomes Yes.

Step S64 represents the lower bound of a loop range described in C language. If the above argument i is less than N, return to step S61. Then, the loop is repeated for the next argument i. If the argument i is N or more, return to the overall flow chart in FIG. 4.

<<Process for Correcting Finished Fuel Injection Flag>>

Figure 10:
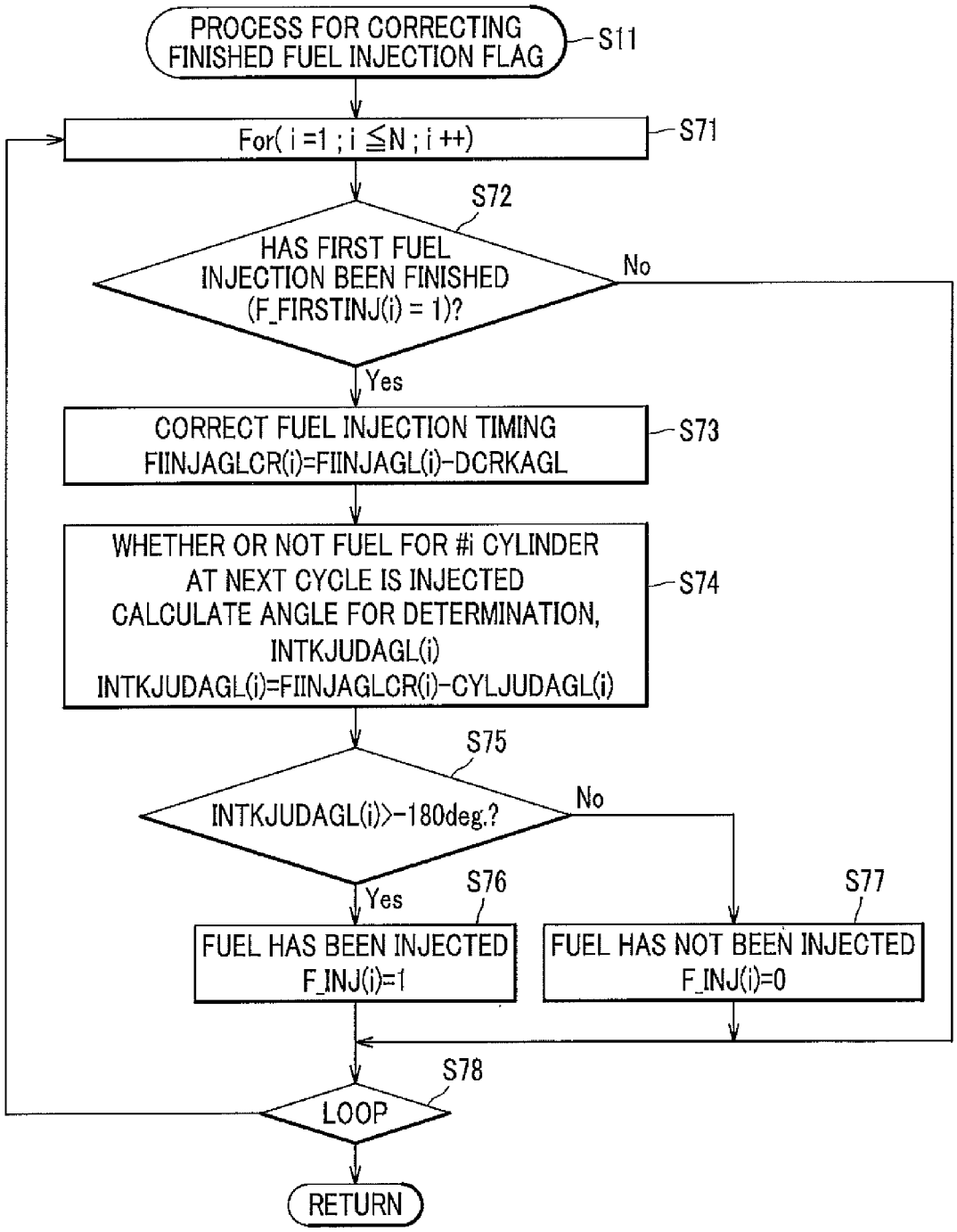
FIG. 10 is a detailed flow chart illustrating a control flow of a process for correcting a finished fuel injection flag.

Next, by referring to FIG. 10, detailed control is described regarding a "PROCESS FOR CORRECTING FINISHED FUEL INJECTION FLAG" in step S11 of the overall flow chart shown in FIG. 4. FIG. 10 is a detailed flow chart illustrating a control flow of a process for correcting a finished fuel injection flag. The fuel injection-controlling device 215A executes this control process at each predetermined crank angle.

At step S71, a loop counter is described in C language, a kind of programming language. This step means starting a loop from 1 to N of the argument i.

At step S72, whether or not the first fuel injection has been finished (F_FIRSTINJ(i)=1) is checked. If the first fuel injection has been finished (Yes), go to step S73. If not (No), go to step S78.

At step S73, the first fuel injection timing is corrected. Specifically, a calculation, FIINJAGLCR(i)=FIINJAGL(i)−DCRKAGL, is carried out. Here, the FIINJAGL(i) is stored at step S54 in the detailed flow chart shown in FIG. 8. The DCRKAGL represents a difference DCRKAGL calculated at step S08 in the overall flow chart shown in FIG. 4. Then, the actual crank angle FIINJAGLCR(i) indicating the first fuel injection timing is calculated in a range from 540 to −174 degrees in a manner similar to that of the crank angle CA(i). Specifically, −180 degrees are read as 540 degrees.

At step S74, INTKJUDAGL(i) is calculated which is an angle to determine whether or not the next fuel injection of the #i cylinder is performed. Specifically, a calculation, INTKJUDAGL(i)=FIINJAGLCR(i)−CYLJUDAGL(i), is carried out. Here, the CYLJUDAGL(i) represents a crank angle advance CYLJUDAGL(i) from the first fuel injection timing stored at step S63 in the detailed flow chart shown in FIG. 9. Then, the value of INTKJUDAGL(i) as herein calculated has a maximum of 540 degrees. The value corresponds to this crank angle or less, and there is provided no lower limit regarding the negative value side.

Figure 11:
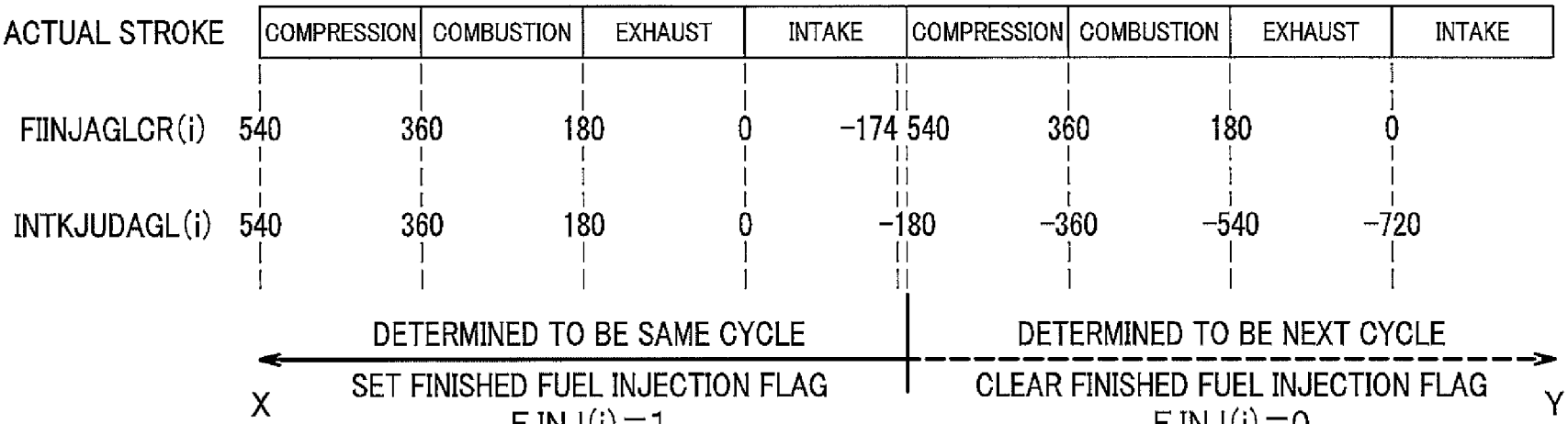
FIG. 11 illustrates setting of FIINJAGLCR(i), which is an actual fuel injection timing (designated as crank angles), and INTKJUDAGL(i), which is an angle to determine whether or not fuel for the #i cylinder at the next cycle is injected. These parameters are used to correct a finished fuel injection flag, F_INJ(i).

FIG. 11 illustrates setting of FIINJAGLCR(i), which is an actual fuel injection timing (designated as crank angles), and INTKJUDAGL(i), which is an angle to determine whether or not fuel for the #i cylinder at the next cycle is injected. These parameters are used to correct an finished fuel injection flag, F_INJ(i).

The CYLJUDAGL(i) is always a positive value. Thus, the value of INTKJUDAGL(i) is not larger than the value of FIINJAGLCR(i). Then, the value of INTKJUDAGL(i) permits, for example, a negative value up to −720.

At step S75, whether or not the INTKJUDAGL(i) is larger than −180 degrees is checked ("INTKJUDAGL(i)>−180 degrees"). If the INTKJUDAGL(i) is greater than −180 degrees (Yes), go to step S76. Then, the fuel injection is finished. That is, if the existing finished fuel injection flag F_INJ(i)=1, the flag remains the same. If the finished fuel injection flag F_INJ(i)=0, the flag is set ("F_INJ(i)=1"). If the INTKJUDAGL(i) is −180 degrees or less (No), go to step S77. Fuel has not been injected. That is, if the existing finished fuel injection flag F_INJ(i)=0, the flag remains the same. If the finished fuel injection flag F_INJ(i)=1, the flag is cleared ("F_INJ(i)=0").

When INTKJUDAGL(i)>−180 degrees, which is within region X, as described in FIG. 11, it is determined that the present actual crank angle is within the same cycle as for the first fuel injection of the #i cylinder according to the memory-based crank angle. That is, fuel for the first fuel injection is determined to have not yet been burned. Thus, if the finished fuel injection flag F_INJ(i) has already been set, the flag remains the same. If the flag has not been set, the frag is set. Alternatively, when INTKJUDAGL(i)≤−180 degrees, which is within region Y, as described in FIG. 11, it is determined that the present actual crank angle is within the next cycle to the first fuel injection of the #i cylinder according to the memory-based crank angle. That is, fuel for the first fuel injection has already been introduced into a cylinder and the present actual angle is determined to indicate the next cycle. Thus, if the finished fuel injection flag F_INJ(i) has been set, the flag is cleared. If the flag has not been set, the frag remains the same.

After step S76 or S77, go to step S78. Step S78 represents the lower bound of a loop range described in C language. If the above argument i is less than N, return to step S71. Then, the loop is repeated for the next argument i. If the argument i is N or more, return to the overall flow chart in FIG. 4.

The process for correcting a finished fuel injection flag is based on correcting such a difference between the memory-based crank angle at the time of starting the engine and the actual crank angle. This process, depending on the need, corrects the finished fuel injection flag F_INJ(i) only for the first fuel injection performed according to the memory-based crank angle before $t_{JUD}$ (see FIG. 12), an actual stroke determination timing (also referred to as "incorrect storage determination timing") that gives Yes at step S07 in the overall flow chart shown in FIG. 3.

In this embodiment, the actual crank angle is determined from the TDC and CRK pulse shapes at every 180 degrees as illustrated in FIG. 2. The above is consideration that all the first fuel injection of each cylinder is not necessarily performed before the incorrect storage determination timing $t_{JUD}$.

As used herein, an "injection timing-determining unit" set forth in the appended Claims corresponds to steps S73 to S77 in the detailed flow chart illustrating a control flow of a process for correcting a finished fuel injection flag as shown in FIG. 10.

Figure 12A:
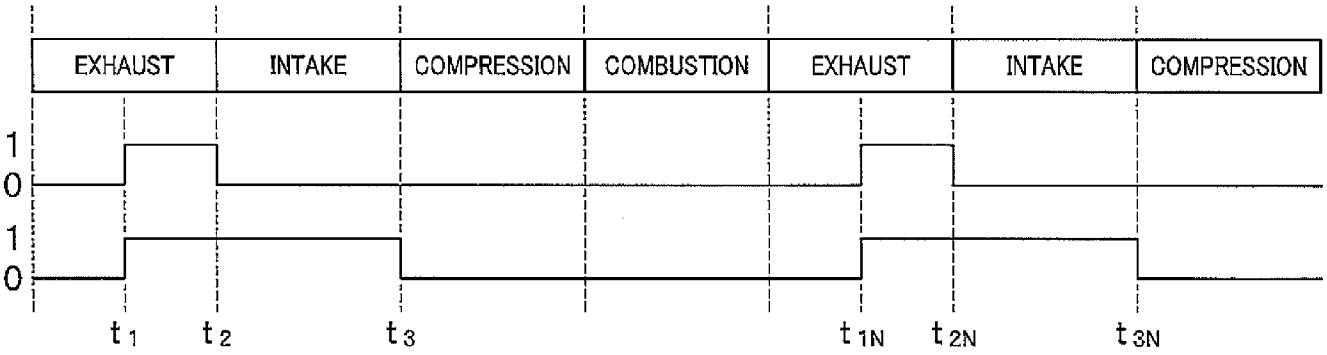
FIG. 12 illustrates a procedure for correcting a finished fuel injection flag in the case of injection during an exhaust stroke in a port-injection engine.
Figure 12B:
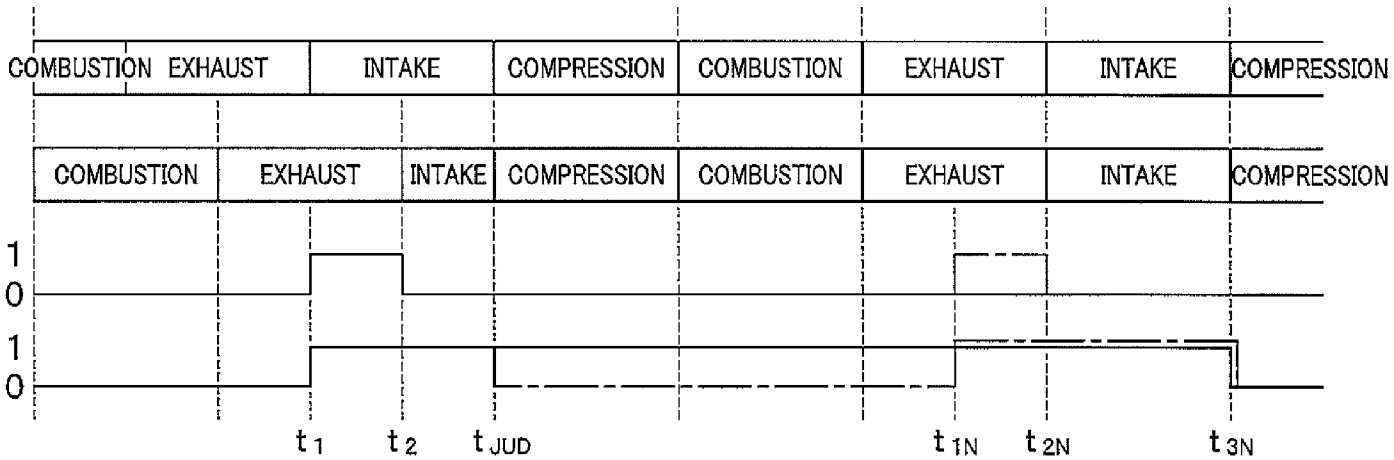

With reference to FIG. 12, the following describes the results of the next fuel injection control after the first fuel injection according to the memory-based crank angle of each cylinder at the time of starting the engine in this embodiment.

FIG. 12 illustrates a procedure for correcting a finished fuel injection flag in the case of injection during an exhaust stroke in a port-injection engine. FIG. 12(*a*) illustrates a normal driving condition. FIG. 12(*b*) illustrates how to correct a finished fuel injection flag in Example 1 which represents storage of incorrect crank angle at the time of stating the engine.

FIG. 12(*a*) includes a bar chart indicating an actual stroke, a control signal (hereinafter, referred to as "INJ SIGNAL") indicating a valve open period output from the fuel injection-controlling device 215A to the fuel injection valve 20A (see FIG. 1) of each cylinder, and a finished fuel injection flag F_INJ (in the flow chart, designated as F_INJ(i) containing the argument i indicating the cylinder number). FIG. 12(*a*) illustrates a normal driving condition. In that case, the INJ SIGNAL is turned on (in FIG. 12, designated as "1") only during a predetermined period from $t_1$ to $t_2$, the $t_1$ being a start point of the INJOB timing of a predetermined crank angle during an exhaust stroke. The predetermined period from $t_1$ to $t_2$ is modified by an amount of fuel injection according to the torque requirement and environmental conditions such as an engine temperature.

The finished fuel injection flag F_INJ is set (=1) when the INJ SIGNAL is turned on, for example, it reaches the timing $t_1$. When a stroke reaches a compression stroke, the F_INJ is reset (=0) at the timing $t_3$ so as to make the next fuel injection possible.

Next, FIG. 12(*b*) includes a bar chart indicating an actual stroke, a bar chart indicating a stroke recognized by the CPU of the engine controller ECU 27A (in the figure, designated as "ECU-RECOGNIZED STROKE"), an INJ SIGNAL, and a finished fuel injection flag F_INJ. FIG. 12(*b*) illustrates an example as follows: the first fuel injection is performed according to the memory-based crank angle at the time of starting the engine; and then, partway through a stroke that is recognized as an intake stroke according to the memory-based crank angle, for example, at −90 degrees that represent the incorrect crank angle storage determination timing tam, the actual crank angle is determined, based on the TDC and CRK pulse shapes, to enter a compression stroke. In FIG. 12(*b*), the INJ SIGNAL and finished fuel injection flag F_INJ denoted by the solid lines represent the case of a conventional technique. The INJ SIGNAL and finished fuel injection flag F_INJ denoted by the dashed-dotted lines represent portions, in this embodiment, altered from the conventional technique.

As indicated by the INJ SIGNAL, the first fuel injection is turned on only during a predetermined period from $t_1$ to $t_2$ (the fuel injection timing), the $t_1$ being a start point of the INJOB timing of a predetermined crank angle during an exhaust stroke according to the memory-based crank angle. Then, the finished fuel injection flag F_INJ is set (=1) at the timing $t_1$ at which the INJ SIGNAL is turned on. At the incorrect crank angle storage determination timing $t_{JUD}$, a process (step S05 in FIG. 3) for initializing a finished fuel injection flag is carried out at the memory-based crank angle (here, during an intake stroke). Consequently, the finished fuel injection flag F_INJ remains 1. In the subsequent process, the crank angle is corrected based on the incorrect crank angle storage determination (step S10 in FIG. 4). Since the process for initializing a finished fuel injection flag F_INJ in the next process cycle has already passed the initiation of a compression stroke, the finished fuel injection flag is not cleared. Hence, even after the timing $t_{JUD}$, the finished fuel injection flag F_INJ as denoted by the solid line remains 1. Accordingly, during a predetermined period from $t_{1N}$ to $t_{2N}$ within the next exhaust stroke, the fuel injection control cannot be executed. Specifically, as illustrated in step S43 of the detailed flow chart regarding a process for executing a fuel injection in FIG. 7, when the finished fuel injection flag F_INJ(i) is not 1, it is possible to go to step S44 to perform a fuel injection.

This embodiment, however, determines storage of incorrect crank angle at the timing $t_{JUD}$ as illustrated in FIG. 12(*b*), and corrects a stroke recognized by the ECU. In the fuel injection-controlling device 215A, the actual crank angle FIINJAGLCR(i) indicating the first fuel injection timing is 0 degrees as described in FIG. 11. The CYLJUDAGL(i), a crank angle advance from the first fuel injection timing, is 180 degrees. Hence, ITKJUDAGL=0-180=−180 degrees, which is −180 degrees or less. Thus, the finished fuel injection flag F_INJ that has been set at step S11 in FIG. 4 is cleared (=0) as designated by the dashed-dotted line after the incorrect crank angle storage determination timing $t_{JUD}$. As a result, in the fuel injection-controlling device 215A, the finished fuel injection flag F_INJ is reset. Thus, as designated by the dashed-dotted line, when the next fuel injection is performed according to the actual crank angle, the INJ SIGNAL is output during a period from $t_{1N}$ to $t_{2N}$ within an exhaust stroke. As associated with the INJ SIGNAL, the finished fuel injection flag F_INJ is set during a period from $t_{1N}$ to $t_{3N}$ as designated by the dashed-dotted line.

As illustrated in FIG. 12(*b*), when the first fuel injection (the INJ SIGNAL during $t_1$ to $t_2$) is converted to that at the actual crank angle, the first fuel injection has been executed during an intake stroke. Thus, the injected fuel is reasonably introduced into the cylinder. If fuel is not injected during a period from $t_{1N}$ to $t_{2N}$ at the next exhaust stroke, which is the first fuel injection timing after the determination of the actual stroke at the incorrect crank angle storage determination timing $t_{JUD}$, fuel is not to be introduced into the cylinder at this combustion cycle. This causes misfire, so that the engine rotation at the time of starting the engine cannot be smooth. Hence, the fuel injection-controlling device 215A controls whether or not the next fuel injection of the #i cylinder is performed as follows: whether or not the next fuel injection of the #i cylinder at the expected first fuel injection timing after the determination of the actual stroke occurs at the same fuel combustion timing as that of the first fuel injection based on the stored crank angle CA(i) before the determination of the actual stroke is determined by INTKJUDAGL(i), which is an angle to determine whether or not fuel for the #i cylinder at the next cycle is injected.

In addition, control that an amount of the first fuel injection is subtracted from an amount of the next fuel injection, as described in Patent Literature 1 as a conventional technique, is not carried out. This can prevent misfire due to shortage of the amount of the next fuel injection. That is, deterioration of starting characteristics can be prevented.

Note that the determination by the INTKJUDAGL(i), which is an angle to determine whether or not fuel for the #i cylinder at the next cycle is injected, corresponds to "which determines whether or not fuel to be injected at a first fuel injection timing after the determination of the actual stroke is combined at the same combustion timing" set forth in the appended Claims.

<<Application of First Embodiment to Injection During Intake Stroke>>

Examples of the first embodiment include, but are not limited to, that the fuel injection-controlling device 215A controls a fuel injection through the fuel injection valve 20A during a predetermined period within an exhaust stroke of each cylinder. Likewise, the first embodiment is applicable to the case of injection during an intake stroke in a port-injection engine.

Figure 13A:
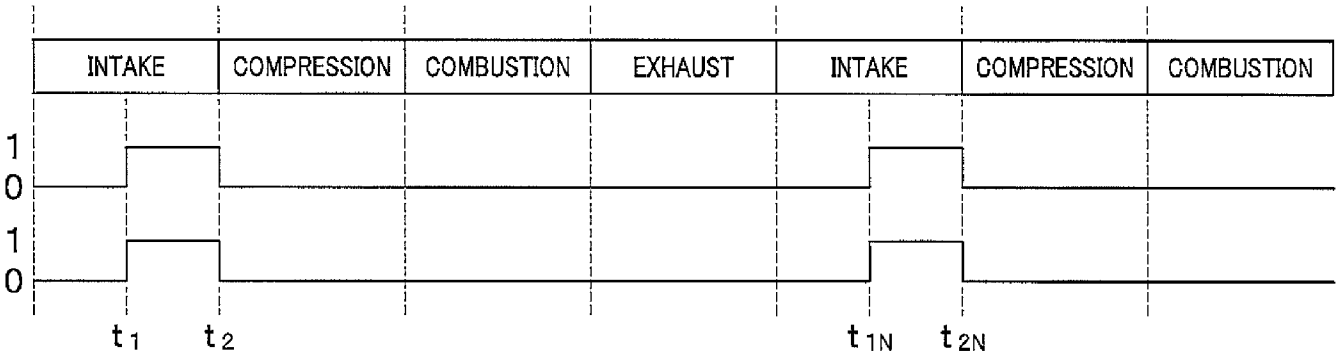
FIG. 13 illustrates a procedure for correcting a finished fuel injection flag in the case of injection during an intake stroke in a port-injection engine.
Figure 13B:
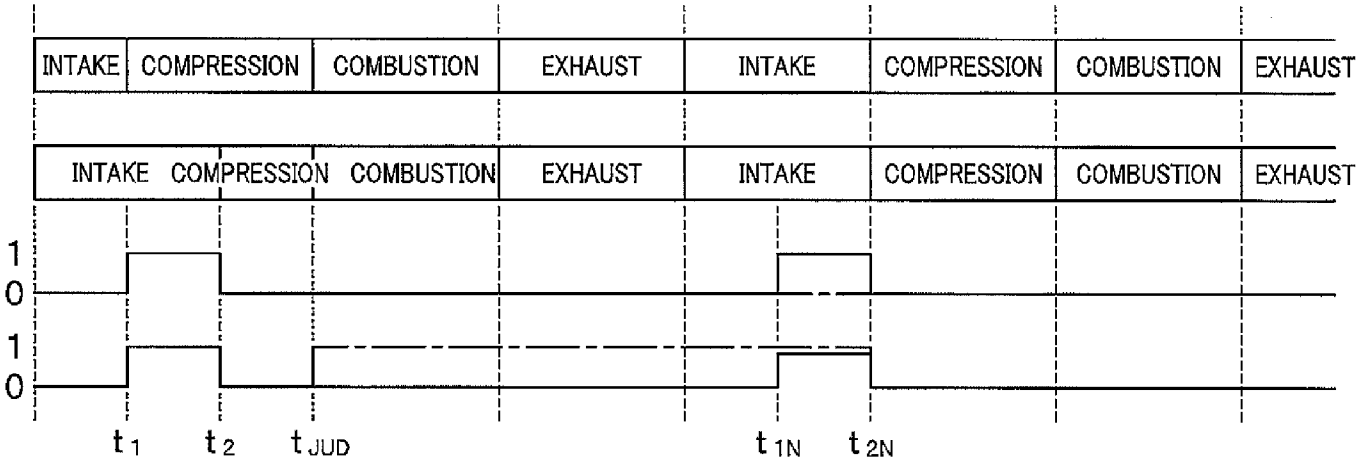

FIG. 13 illustrates a procedure for correcting a finished fuel injection flag in the case of injection during an intake stroke in a port-injection engine. FIG. 13(*a*) illustrates a normal driving condition. FIG. 13(*b*) illustrates how to correct a finished fuel injection flag in Example 2 which represents storage of incorrect crank angle at the time of stating the engine.

FIG. 13(*a*) includes a bar chart indicating an actual stroke, an INJ SIGNAL output from the fuel injection-controlling device 215A to the fuel injection valve 20A (see FIG. 1) of each cylinder, and a finished fuel injection flag F_INJ (in the flow chart, designated as F_INJ(i) containing the argument i indicating the cylinder number). FIG. 13(*a*) illustrates a normal driving condition. In that case, the INJ SIGNAL is turned on (in FIG. 13, designated as "1") only during a predetermined period from $t_1$ to $t_2$, the $t_1$ being a start point of the INJOB timing of a predetermined crank angle during an intake stroke. The predetermined period from $t_1$ to $t_2$ is modified by an amount of fuel injection according to the torque requirement and environmental conditions such as an engine temperature.

The finished fuel injection flag F_INJ is set (=1) when the INJ SIGNAL is turned on, for example, it reaches the timing $t_1$. When a stroke reaches a compression stroke, the F_INJ is reset (=0) at the timing $t_2$ so as to make the next fuel injection possible.

FIG. 13(*b*) includes a bar chart indicating an actual stroke, a bar chart indicating a stoke recognized by the CPU of the engine controller ECU 27A (in the figure, designated as "ECU-RECOGNIZED STROKE"), an INJ SIGNAL, and a finished fuel injection flag F_INJ. FIG. 13(*b*) illustrates an example as follows: the first fuel injection is performed according to the memory-based crank angle at the time of starting the engine; and then, partway through a stroke that is recognized as a compression stroke according to the memory-based crank angle, for example, at 450 degrees that represent the incorrect crank angle storage determination timing $t_{JUD}$, the actual crank angle is determined, based on the TDC and CRK pulse shapes, to enter a combustion stroke. In FIG. 13(*b*), the INJ SIGNAL and finished fuel injection flag F_INJ denoted by the solid lines represent the case of a conventional technique. The INJ SIGNAL and finished fuel injection flag F_INJ denoted by the dashed-dotted lines represent portions, in this embodiment, altered from the conventional technique.

As indicated by the INJ SIGNAL, the first fuel injection is turned on only during a predetermined period from $t_1$ to $t_2$ (the fuel injection timing), the $t_1$ being a start point of the INJOB timing of a predetermined crank angle during an intake stroke according to the memory-based crank angle. Then, the finished fuel injection flag F_INJ is set (=1) at the timing $t_1$ at which the INJ SIGNAL is turned on. Before the incorrect crank angle storage determination timing $t_{JUD}$, a process (step S05 in FIG. 3) for initializing a finished fuel injection flag F_INJ is carried out according to the memory-based crank angle at each CRK pulse detection. Consequently, because the initiation of a compression stroke is recognized to have passed, the finished fuel injection flag F_INJ is reset to 0 at the timing $t_2$ as denoted by the solid line. Accordingly, the conventional technique allows the fuel injection control to be executed even during a predetermined period from $t_{1N}$ to $t_{2N}$ within the next intake stroke after the incorrect crank angle storage determination timing $t_{JUD}$. Specifically, as illustrated in step S43 of the detailed flow chart regarding a process for executing a fuel injection in FIG. 7, when the finished fuel injection flag F_INJ(i) is not 1, it is possible to go to step S44 to perform a fuel injection.

This embodiment, however, determines storage of incorrect crank angle at the timing $t_{JUD}$ as illustrated in FIG. 13(*b*), and corrects a stroke recognized by the ECU. The actual crank angle FIINJAGLCR(i) indicating the first fuel injection timing is 540 degrees as described in FIG. 11. The CYLJUDAGL (i), a crank angle advance from the first fuel injection timing, is 180 degrees. Hence, ITKJUDAGL=540−180=360 degrees, which is greater than −180 degrees. Accordingly, the finished fuel injection flag F_INJ, which has been reset, is set (=1) as designated by the dashed-dotted line after the incorrect crank angle storage determination timing $t_{JUD}$. As a result, in the fuel injection-controlling device 215A, the finished fuel injection flag F_INJ is set. Thus, as designated by the dashed-dotted line, when the next fuel injection is performed according to the actual crank angle, the INJ SIGNAL cannot be output during a period from $t_{1N}$ to $t_{2N}$ within an intake stroke.

As illustrated in FIG. 13(*b*), when the first fuel injection (the INJ SIGNAL during $t_1$ to $t_2$) is converted to that at the actual crank angle, the first fuel injection has been executed at or near the period of initiating a compression stroke. Thus, the above injection is combined in the same cycle with fuel injection during a period from $t_{1N}$ to $t_{2N}$ within the next intake stroke. If, as illustrated in the conventional technique denoted by the solid line, fuel is injected during a period from $t_{1N}$ to $t_{2N}$, two portions of fuel are going to be introduced into this cylinder during the intake stroke. This causes a rich condition, which may emit unburned gas. This embodiment can prevent such emission deterioration.

In view of the above, the first embodiment is found to be easily applicable to the case of injection during an intake stroke in a port-injection engine by just modifying setting of the fuel injection timing INJOB.

In the case of injection during an exhaust stroke and in the case of injection during an intake stroke of a port-injection engine, immediately after completion of the process for initializing the microcomputer 27*a* of the engine controller ECU 27A at the time of starting the engine, the timing controlling device 211A and the fuel injection-controlling device 215A are set to cooperate, so as to promote a quick start of the engine, to inject fuel at the time of the CRK pulse input, only regarding the first fuel injection of the cylinder that has been determined according to the memory-based crank angle CA(i) as undergoing the first combustion.

Modified Example of First Embodiment

Figure 14A:
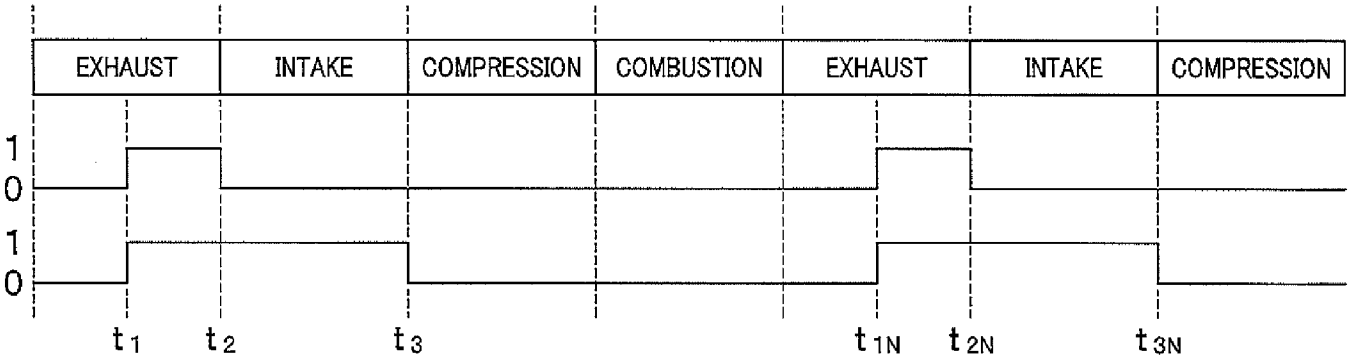
FIG. 14 illustrates a procedure for correcting a finished fuel injection flag in the case of injection during an exhaust stroke in the port-injection engine that has modifications in the first embodiment.
Figure 14B:
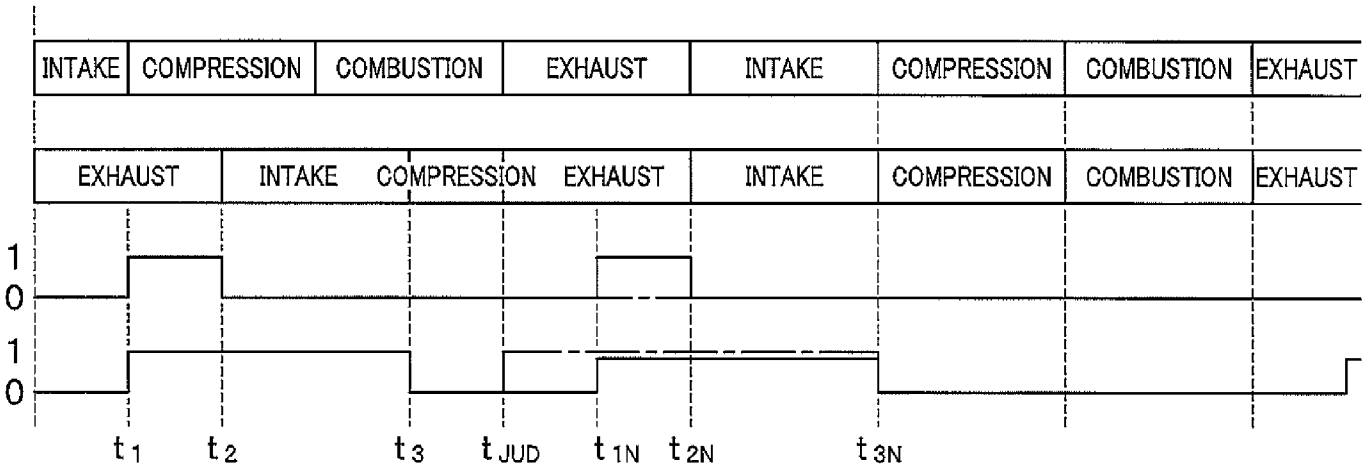

The following describes a modified example of the first embodiment by referring to FIG. 14.

In the above first embodiment, the determination of the actual crank angle by the combination between the TDC and CRK pulse shapes is carried out, but is not limited to, at the TDC pulse timing with a 180-degree interval. In this modified example, a single pulse with a simple predetermined angle width may represent a TDC pulse shape indicating TDC, namely a position of initiating a combustion stroke of each cylinder. A CRK pulse shape that is combined with the TDC pulse shape may be defined, for example, by a pulse with a wide interval of the TDC pulse position regarding only one cylinder. This allows the TDC of a representative cylinder among four cylinders to be distinguished, thereby determining the actual crank angle. In that case, the CYLJUDAGL(i) may advance a maximum of 720 degrees from the time of the first injection of the foregoing cylinder according to the memory-based crank angle to the determination of the actual crank angle. The same as in the first embodiment, however, can apply to this case.

As illustrated in the previously-described first embodiment shown in FIG. 2, the actual crank angle can be determined by the combination between the TDC and CRK pulse shapes at every 180 degrees. That case differs from this example. Accordingly, with reference to FIG. 14, the following describes, for example, a process for correcting a finished fuel injection flag in the case of injection during an exhaust stroke in a port-injection engine when the actual cylinder is determined once every 720 degrees of crank angle by using the representative cylinder. FIG. 14 illustrates a procedure for correcting a finished fuel injection flag in the case of injection during an exhaust stroke in the port-injection engine that has modifications in the first embodiment. FIG. 14(*a*) illustrates a normal driving condition. FIG. 14(*b*) illustrates how to correct a finished fuel injection flag in Example 3 which represents storage of incorrect crank angle at the time of stating the engine.

FIG. 14(*a*) is the same as FIG. 12(*a*), so that the redundant description is omitted.

FIG. 14(*b*) includes a bar chart indicating an actual stroke, a bar chart indicating a stoke recognized by the CPU of the engine controller ECU 27A (in the figure, designated as "ECU-RECOGNIZED STROKE"), an INJ SIGNAL, and a finished fuel injection flag F_INJ. FIG. 14(*b*) illustrates an example as follows: the first fuel injection is performed according to the memory-based crank angle at the time of starting the engine; and then, partway through a stroke that is recognized as a compression stroke according to the memory-based crank angle, for example, at 450 degrees that represent the incorrect crank angle storage determination timing $t_{JUD}$, the actual crank angle is determined, based on the TDC and CRK pulse shapes, to enter an exhaust stroke. In FIG. 14(*b*), the INJ SIGNAL and finished fuel injection flag F_INJ denoted by the solid lines represent the case of a conventional technique. The INJ SIGNAL and finished fuel injection flag F_INJ denoted by the dashed-dotted lines represent portions, in this modified example, altered from the conventional technique.

As indicated by the INJ SIGNAL, the first fuel injection is turned on only during a predetermined period from $t_1$ to $t_2$ (the fuel injection timing), the $t_1$ being a start point of the INJOB timing of a predetermined crank angle during an exhaust stroke according to the memory-based crank angle. Then, the finished fuel injection flag F_INJ is set (=1) at the timing $t_1$ at which the INJ SIGNAL is turned on. Before the incorrect crank angle storage determination timing $t_{JUD}$, that is, before determination of storage of incorrect crank angle, the initiation of a compression stroke is recognized to have passed. Thus, the finished fuel injection flag F_INJ is reset to 0 at the timing $t_3$ as denoted by the solid line. Accordingly, the conventional technique allows the fuel injection control to be executed even during a predetermined period from $t_{1N}$ to $t_{2N}$ within the next exhaust stroke after the incorrect crank angle storage determination timing $t_{JUD}$. Specifically, as illustrated in step S43 of the detailed flow chart regarding a process for executing a fuel injection in FIG. 7, when the finished fuel injection flag F_INJ(i) is not 1, it is possible to go to step S44 to perform a fuel injection.

This modified example, however, determines storage of incorrect crank angle at the timing $t_{JUD}$ as illustrated in FIG. 14(*b*), and corrects a stroke recognized by the ECU. In the fuel injection-controlling device 215A, the actual crank angle FIINJAGLCR(i) indicating the first fuel injection timing regarding the cylinder in FIG. 14(*b*) is 540 degrees as described in FIG. 11. The CYLJUDAGL(i), a crank angle advance from the first fuel injection timing, is 360 degrees. Hence, ITKJUDAGL=540−360=180 degrees, which is greater than −180 degrees. Accordingly, the finished fuel injection flag F_INJ, which has been reset, is set (=1) as designated by the dashed-dotted line after the incorrect crank angle storage determination timing $t_{JUD}$. As a result, in the fuel injection-controlling device 215A, the finished fuel injection flag F_INJ is set. Thus, as designated by the dashed-dotted line, when the next fuel injection is performed according to the actual crank angle, the INJ SIGNAL cannot be output during a period from $t_{1N}$ to $t_{2N}$ within an exhaust stroke.

As illustrated in FIG. 14(*b*), when the first fuel injection (the INJ SIGNAL during $t_1$ to $t_2$) is converted to that at the actual crank angle, the first fuel injection has been executed at or near the period of initiating a compression stroke. Thus, the above injection is combined in the same cycle with fuel injection during a period from $t_{1N}$ to $t_{2N}$ within the next exhaust stroke, which is the first fuel injection timing after the determination of the actual stroke at the incorrect crank angle storage determination timing $t_{JUD}$. If fuel is injected during a period from $t_{1N}$ to $t_{2N}$, two portions of fuel are going to be introduced into this cylinder during the intake stroke. This causes a rich condition, which may emit unburned gas. This modified example can prevent such emission deterioration.

Second Embodiment

Figure 15:
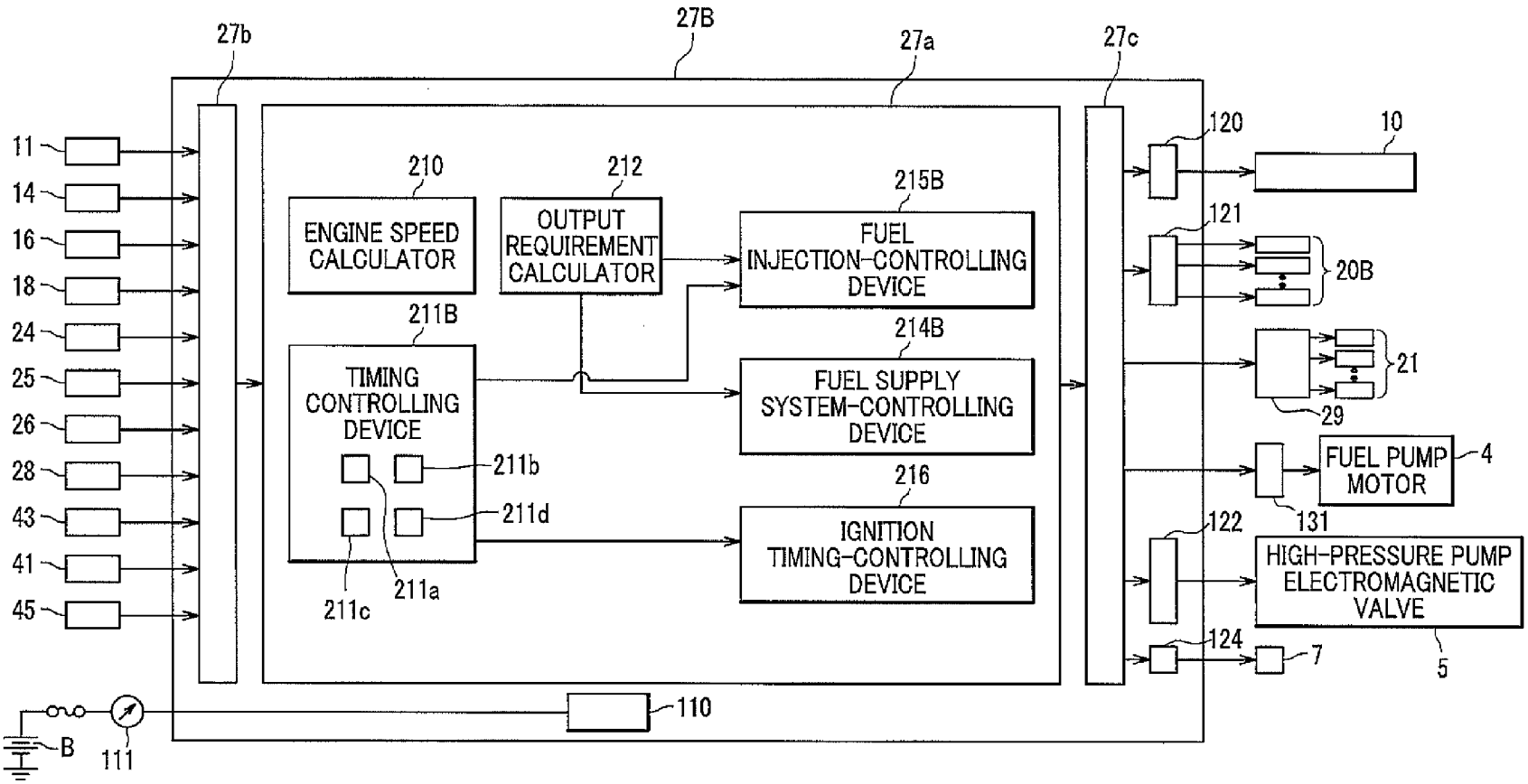
FIG. 15 is a block diagram illustrating an engine controller ECU of the second embodiment.

Next, with reference to FIG. 15, briefly described is a prototype internal-combustion engine having an internal-combustion engine controller according to the second embodiment of the present invention. This embodiment has a fuel supply system different from that of the prototype internal-combustion engine according to the first embodiment. In respect to elements identical to those of the prototype internal-combustion engine according to the first embodiment, the redundant description is omitted.

(Overview of Internal-Combustion Engine)

A prototype internal-combustion engine having an internal-combustion engine controller according to the second embodiment is what is called a direct-injection engine (direct-injection internal-combustion engine). Thus, a cylinder head of the engine main unit is installed with an intake valve, an exhaust valve, a fuel injection valve 20B (see FIG. 15) that directly injects fuel into a combustion chamber of each cylinder, and a spark plug 21 (see FIG. 15).

In the internal-combustion engine, fuel is supplied from a fuel tank (not shown) to a high-pressure pump (not shown) by means of a fuel pump motor 4 (see FIG. 15)-integrated fuel pump via a feed pipe (not shown). The pressure of the fuel is raised by the high-pressure pump (not shown) operated by each camshaft (not shown) of the engine main unit, and the fuel is transported to a delivery pipe (not shown). The pressure of the fuel inside the delivery pipe is adjusted by a regulator 7, which is connected to the delivery pipe and controlled by an engine controller ECU 27B. The excessive fuel is returned to the fuel tank via a return pipe (not shown).

The fuel is supplied from the delivery pipe via the respective four high-pressure fuel supply pipes (not shown) to fuel injection valves 20B for the respective cylinders.

In this connection, this embodiment uses a below-described fuel injection-controlling device (fuel injection-controlling unit) 215B, which functions to run a CPU of the engine controller ECU 27B, to control the fuel injection valve 20B so as to inject fuel during, for example, a compression or combustion stroke.

The delivery pipe has a fuel pressure sensor 41 that detects a pressure inside the delivery pipe (hereinafter, referred to as a "fuel pressure").

The fuel pump has a fuel pump motor 4, the supplied power of which is turned on or off and is switched between low load (Low) and high load (Hi) by the engine controller ECU 27B.

The high-pressure pump has a built-in high-pressure pump electromagnetic valve 5 controlled by the engine controller ECU 27B, and can be switched between discharge setting and non-discharge setting. Furthermore, controlled by the engine controller ECU 27B, the high-pressure pump can operate under the discharging setting regardless of the time of low load (Low) or high load (Hi). In this connection, a check valve is disposed at an outlet of the high-pressure pump. During the non-discharge setting, it is possible to prevent fuel from regurgitating from the delivery pipe to the feed pipe.

<<Functions of Engine Controller ECU>>

Next, differences between functions of the engine controller ECU of this embodiment and those of the first embodiment are described by referring to FIG. 15. FIG. 15 is a block diagram illustrating an engine controller ECU of the second embodiment The engine controller ECU 27B receives outputs from sensors 11, 14, 16, 18, 24, 25, 26, and 28, an output from an accelerator position sensor 43, an output from a vehicle speed sensor 45, outputs from a fuel pressure sensor 41 and a fuel temperature sensor (not shown), and other outputs.

This engine controller ECU 27B primarily includes a microcomputer 27*a*. This microcomputer 27*a*, for example, allows the CPU to execute a program stored in a ROM to control, depending on a stepping amount of an accelerator pedal manipulated by a driver and on a driving condition of the engine, a position of a throttle valve (not shown), an amount of fuel injection through the fuel injection valve 20B, an ignition timing of the spark plug 21, and a fuel pressure of the delivery pipe by means of operation control of the high-pressure pump electromagnetic valve 5 and the regulator 7.

Meanwhile, the engine controller ECU 27B includes a driver circuit 121 operating the fuel injection valves 20B, a driver circuit 122 operating the high-pressure pump electromagnetic valve 5, and a driver circuit 124 operating an electromagnetic valve included in the regulator 7.

An IG-SW 111 turns on an ECU source circuit 110. This turns on power supply to an ignitor (not shown) that generates and feeds high voltage to a distributor 29.

The microcomputer 27*a* includes, for example, an engine speed calculator 210, a timing controlling device 211B, an output requirement calculator 212, a fuel supply system-controlling device 214B, a fuel injection-controlling device 215B, and an ignition timing-controlling device 216, all of which are functional units to achieve an objective by reading and executing a program stored in the ROM.

The same as in the first embodiment applies to functions of the engine speed calculator 210, the output requirement calculator 212, and the ignition timing-controlling device 216. There are some differences in functions of the timing controlling device 211B, the fuel supply system-controlling device 214B, and the fuel injection-controlling device 215B (Timing Controlling Device)

In order to regulate a whole engine controller, the timing controlling device 211B detects an operation position signal of the IG-SW 111 and sets an operation position detection flag, FLAGIGSW, corresponding to the operation position signal. In addition, the timing controlling device 211B detects, based on the CRK and TDC pulses, the TDC timing of the initiation of an intake stroke of each cylinder as a reference crank angle (=0 (zero) degrees). Then, the reference crank angle θ (zero) degrees are read as 720 degrees. Whenever a new CRK pulse is received, 6 degrees, for example, are subtracted from 720 degrees to calculate a present crank angle of each cylinder. Then, the crank angles are stored in crank angle storage devices 211*a*, 211*b*, 211*c*, and 211*d*. That is, the crank angle is defined from 0 degrees as a start point to 714, 708, . . . , 12, 6, and 0 degrees by subtracting 6 degrees of the CRK pulse corresponding to the positive rotational direction around the crankshaft.

Specifically, these crank angle storage devices 211*a*, 211*b*, 211*c*, and 211*d* each include a high-speed nonvolatile memory. As used herein, the crank angle storage devices 211*a*, 211*b*, 211*c*, and 211*d* correspond to a "cylinder-determining information storing unit" set forth in the appended Claims.

In addition, in the second embodiment, for example, as described in the modified example of the first embodiment, a single pulse with a simple predetermined angle width may represent a TDC pulse shape indicating TDC, namely a position of initiating a combustion stroke of each cylinder. A CRK pulse shape that is combined with the TDC pulse shape may be defined by a pulse with a wide interval regarding only the TDC pulse of one cylinder. This allows the TDC of a representative cylinder among four cylinders to be distinguished, thereby determining the actual crank angle. This case is described using an example.

Meanwhile, in the engine controller ECU 27B, when the IG-SW 111 is turned to the ON position for ignition, the microcomputer 27*a* is booted to initiate an initializing process. In addition, when the IG-SW 111 is turned to a starter drive position, a starter starts rotating the engine. When the microcomputer 27*a* completes the initializing process, the timing controlling device 211B starts reading CRK and TDC pulses periodically. Immediately after completion of the initializing process at the time of starting the engine, the timing controlling device 211B calculates a crank angle of each cylinder as follows: crank angles stored in the crank angle storage devices 211*a*, 211*b*, 211*c*, and 211*d* at the time of the last stoppage of the engine are used; and 6 degrees are subtracted at each CRK pulse detection from the stored crank angle to yield a crank angle of each cylinder. The crank angle as so calculated is referred to as a "memory-based crank angle" or "first unit-based crank angle".

Then, after the completion of the initializing process by the microcomputer 27*a*, the timing controlling device 211B determines, in a manner similar to those of the modified example of the first embodiment, whether or not, at the timing of detecting the first TDC pulse, the memory-based crank angle is the same as the crank angle of each cylinder that has been determined based on the combination between the CRK and TDC pulse shapes. When these angles are the same, the crank angle of each cylinder remains the same, and is updated and newly stored in the crank angle storage devices 211*a*, 211*b*, 211*c*, and 211*d*. Hereinafter, the crank angle of each cylinder that has been determined based on the combination between the CRK and TDC pulse shapes is referred to as a "hardware-based crank angle" or "second unit-based crank angle".

When the memory-based crank angle fails to match with the hardware-based crank angle, a difference between the crank angles of each cylinder is corrected. Then, 6 degrees are subtracted from the corrected crank angle at each CRK pulse detection to update the crank angle of each cylinder. The resulting crank angles are newly stored in the crank angle storage devices 211*a*, 211*b*, 211*c*, and 211*d*.

At the initial period of starting the engine, the timing controlling device 211B outputs the memory-based crank angle to the fuel injection-controlling device 215B and the ignition timing-controlling device 216. Then, this memory-based crank angle is checked by the hardware-based crank angle. When there is a difference between the memory-based crank angle and the hardware-based crank angle, the memory-based crank angle is determined to be incorrect. At that time, the memory-based crank angle is corrected to the hardware-based crank angle. Then, the corrected crank angle is output to the fuel injection-controlling device 215B and the ignition timing-controlling device 216.

(Fuel Supply System-Controlling Device)

The fuel supply system-controlling device 214B controls a rotation speed of the fuel pump motor 4, the high-pressure pump electromagnetic valve 5 of the high-pressure pump operated based on the signal from the fuel pressure sensor 41, and the regulator 7. The fuel supply system-controlling device 214B adjusts a fuel pressure based on a predetermined target fuel pressure map using an engine speed Ne and a torque requirement as parameters.

For example, based on a predetermined fuel pump control map using the engine speed Ne as a parameter, the rotation speed of the fuel pump motor 4 is controlled and switched between Low and Hi conditions.

In addition, the fuel supply system-controlling device 214B controls, based on the parameters of, for example, the engine speed Ne and the torque requirement, a rate of discharge from the high-pressure pump by regulating the high-pressure pump electromagnetic valve 5 of the high-pressure pump.

(Fuel Injection-Controlling Device)

The fuel injection-controlling device 215B sets an amount of fuel injection depending on an engine speed Ne and a torque requirement calculated by the output requirement calculator 212. Specifically, the device sets, depending on a fuel pressure detected by the fuel pressure sensor 41 of the delivery pipe, a fuel injection period based on a predetermined fuel pressure as a parameter. Based on a timing map (not shown) regarding a predetermined injection initiation according to a signal of a crank angle of each cylinder from the timing controlling device 211B, the fuel injection-controlling device 215B controls the fuel injection valve 20B of each cylinder to inject fuel.

The fuel injection-controlling device 215B regulates an amount of fuel injection based on a signal, corresponding to an oxygen level in exhaust gas, from an exhaust gas sensor 24. This makes it possible to adjust the combustion state that conforms to the exhaust gas regulations.

<<Overall and Detailed Flow Charts Regarding Fuel Injection Control>>

In this embodiment, the overall flow chart is essentially the same as in the first embodiment illustrated in FIGS. 3 and 4. There are, however, some differences in the detailed flow charts regarding the "PROCESS FOR INITIALIZING FINISHED FUEL INJECTION FLAG" of step S05 and regarding the "PROCESS FOR CORRECTING FINISHED FUEL INJECTION FLAG" of step S11. The following describes the differences between this embodiment and the first embodiment on the detailed flow charts regarding the "PROCESS FOR INITIALIZING FINISHED FUEL INJECTION FLAG" of step S05 and regarding the "PROCESS FOR CORRECTING FINISHED FUEL INJECTION FLAG" of step S11.

Figure 16:
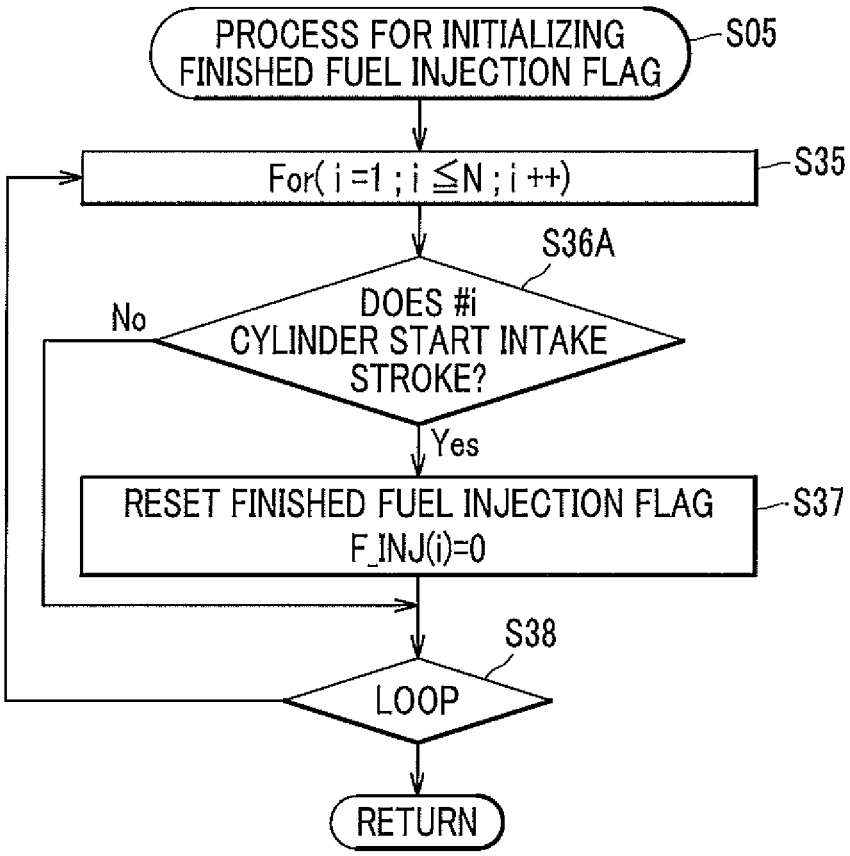
FIG. 16 is a detailed flow chart illustrating a control flow of a process for initializing a finished fuel injection flag.

First, step S36 of the process for initializing a finished fuel injection flag in the detailed flow chart shown in FIG. 6 is read as the "DOES #i CYLINDER START INTAKE STROKE?" of step S36A as shown in FIG. 16.

Figure 17:
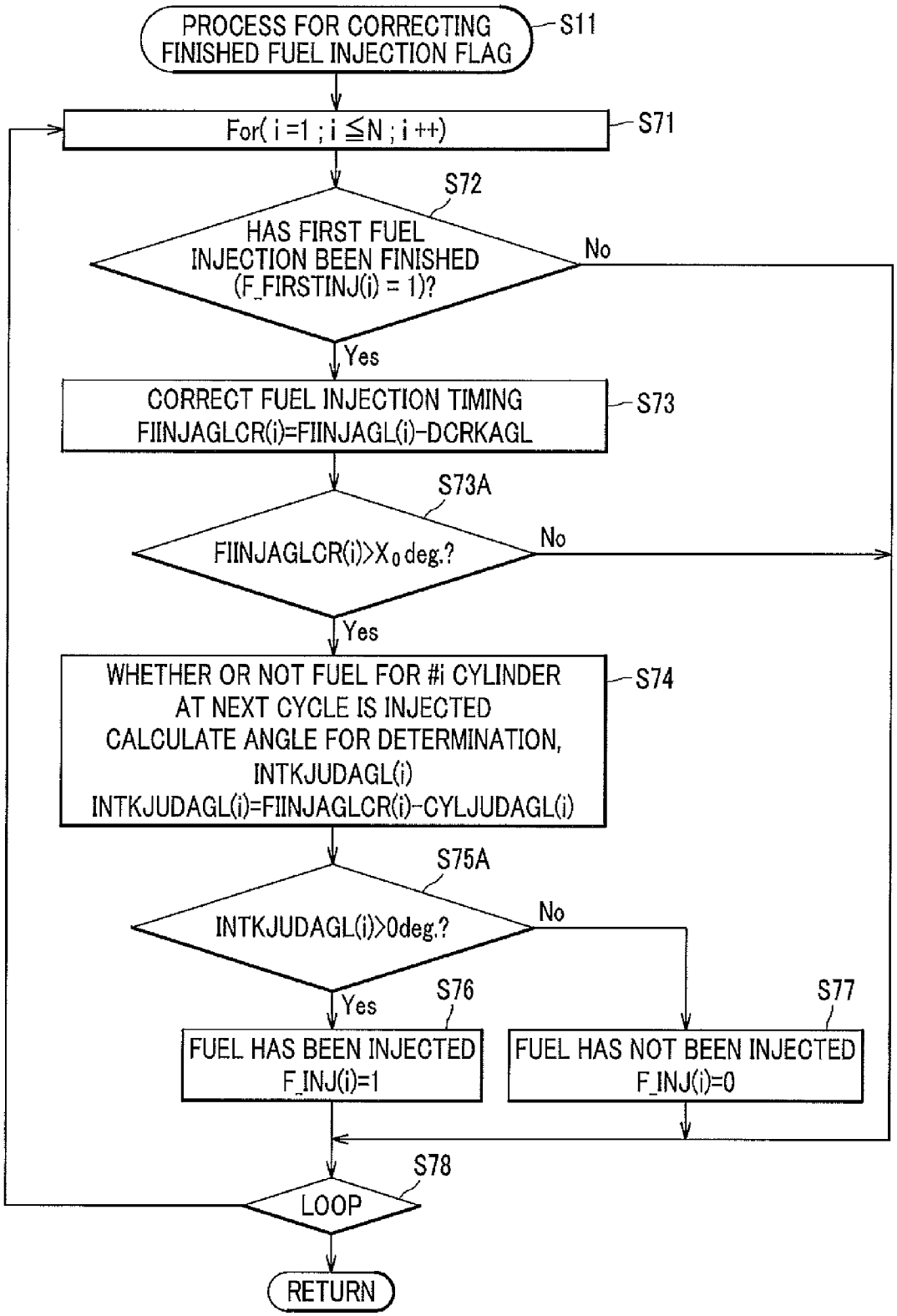
FIG. 17 is a detailed flow chart illustrating a control flow of a process for correcting a finished fuel injection flag.

In addition, in the detailed flow chart regarding the process for correcting a finished fuel injection flag shown in FIG. 10, step 73A is inserted between steps S73 and S74 as illustrated in FIG. 17. At step S73A, whether or not the FIINJAGLCR(i) as calculated in step S73 is larger than a predetermined actual crank angle, $X_0$ degrees, is checked ("FIINJAGLCR(i)>$X_0$ degrees?"). If the FIINJAGLCR(i) is greater than the predetermined actual crank angle, $X_0$ degrees, (Yes), go to step S74. If the FIINJAGLCR(i) is the predetermined actual crank angle, $X_0$ degrees, or less (No), go to step S78.

Here, a value of $X_0$ is, for example, 10 degrees in this embodiment. This value of $X_0$ is predetermined and set by an experiment as follows: when fuel injection into a combustion chamber is initiated during an exhaust stroke, an angle at which fuel is not ejected to an exhaust system and stays inside the combustion chamber is determined.

If step S73A is No, fuel subjected to the first fuel injection during an actual stroke is not ejected to an exhaust system, and stays inside the combustion chamber. In that case, the fuel subjected to the first fuel injection before the determination of the actual stroke and fuel subjected to the next fuel injection after the determination of the actual stroke are combined. Thus, the finished fuel injection flag that has already been set is not corrected. Then, go to step S78.

In addition, the "INTKJUDAGL(i)>−180 deg.?" of step S75 in the detailed flow chart regarding a process for correcting a finished fuel injection flag in FIG. 10 is replaced by the "INTKJUDAGL(i)>0 deg.?" of step S75A as illustrated in FIG. 17.

Then, this embodiment has the FIINJAGL(i) which indicates the first fuel injection timing indicated by the memory-based crank angle, the crank angle CA(i) which is updated and stored in step S04 of the flow chart in FIG. 3, and the FIINJAGLCR(i) which is the actual crank angle at the first fuel injection timing as calculated in step S73 of the detailed flow chart in FIG. 17. In all of them, the initiation of an intake stroke is defined as 0 degrees. At the time of subtraction from 0 degrees, the value is read as 720 degrees. The value is defined as from 714 to 708, . . . , 12, 6, and 0 degrees by subtracting 6 degrees of the CRK pulse corresponding to the positive rotational direction around the crankshaft.

As used herein, an "injection timing-determining unit" set forth in the appended Claims corresponds to steps S73 to S77 in the detailed flow chart illustrating a control flow of a process for correcting a finished fuel injection flag as shown in FIG. 17.

Figure 18:
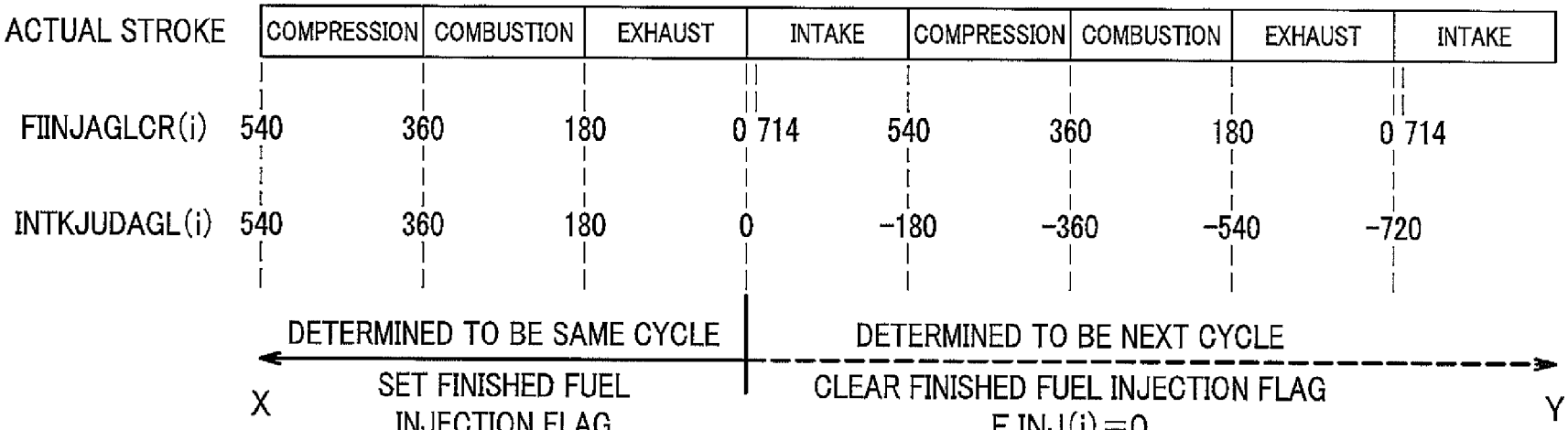
FIG. 18 illustrates setting of FIINJAGLCR(i), which is an actual fuel injection timing (designated as crank angles), and INTKJUDAGL(i), which is an angle to determine whether or not fuel for the #i cylinder at the next cycle is injected. These parameters are used to correct a finished fuel injection flag, F_INJ(i).

FIG. 18 illustrates setting of FIINJAGLCR(i), which is an actual fuel injection timing (designated as crank angles), and INTKJUDAGL(i), which is an angle to determine whether or not fuel for the #i cylinder at the next cycle is injected. These parameters are used to correct an finished fuel injection flag, F_INJ(i).

In this embodiment, a value of INTKJUDAGL(i), which is an angle to determine whether or not fuel for the #i cylinder at the next cycle is injected, has a maximum of 540 degrees as illustrated in FIG. 18. The value corresponds to this crank angle or less, and there is provided no lower limit regarding the negative value side.

Figure 19A:
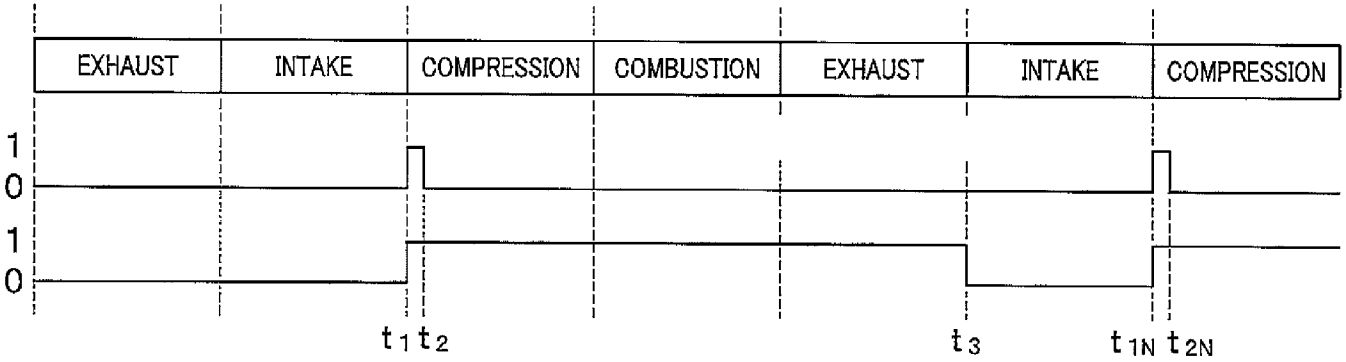
FIG. 19 illustrates a procedure for correcting a finished fuel injection flag in the case of injection during a compression stroke in a direct-injection engine.
Figure 19B:
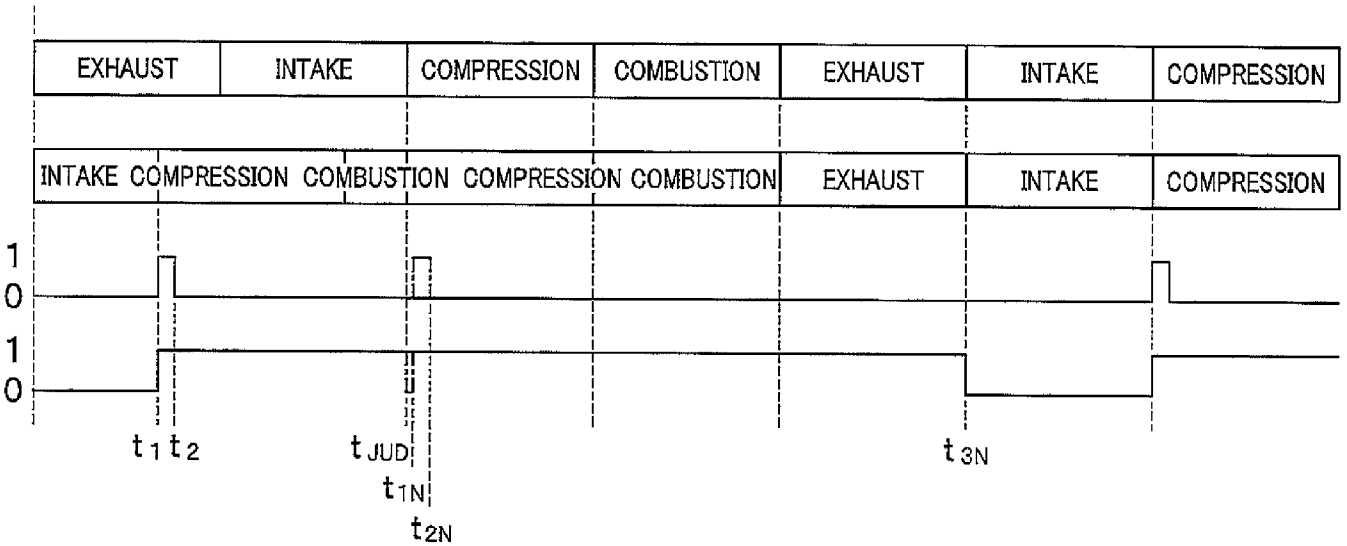

With reference to FIG. 19, the following describes the results of the next fuel injection control after the first fuel injection according to the memory-based crank angle of each cylinder at the time of starting the engine in this embodiment.

FIG. 19 illustrates a procedure for correcting a finished fuel injection flag in the case of injection during a compression stroke in a direct-injection engine. FIG. 19(*a*) illustrates a normal driving condition. FIG. 19(*b*) illustrates how to correct a finished fuel injection flag in Example 1 which represents storage of incorrect crank angle at the time of starting the engine.

FIG. 19(*a*) includes a bar chart indicating an actual stroke, an INJ SIGNAL output from the fuel injection-controlling device 215B to the fuel injection valve 20B (see FIG. 15) of each cylinder, and a finished fuel injection flag F_INJ (in the flow chart, designated as F_INJ(i) containing the argument i indicating the cylinder number). FIG. 19(*a*) illustrates a normal driving condition. In that case, the INJ SIGNAL is turned on (in FIG. 19, designated as "1") only during a predetermined period from $t_1$ to $t_2$, the $t_1$ being a start point of the INJOB timing of a predetermined crank angle during a compression stroke. The predetermined period from $t_1$ to $t_2$ is modified by an amount of fuel injection according to the torque requirement and environmental conditions such as an engine temperature.

The finished fuel injection flag F_INJ is set (=1) when the INJ SIGNAL is turned on, for example, it reaches the timing $t_1$. When a stroke reaches an intake stroke, the F_INJ is reset (=0) at the timing $t_3$ so as to make the next fuel injection possible.

Next, FIG. 19(*b*) includes a bar chart indicating an actual stroke, a bar chart indicating a stoke recognized by the CPU of the engine controller ECU 27B (in the figure, designated as "ECU-RECOGNIZED STROKE"), an INJ SIGNAL, and a finished fuel injection flag F_INJ. FIG. 19(*b*) illustrates an example as follows: the first fuel injection is performed according to the memory-based crank angle at the time of starting the engine; and then, partway through a stroke that is recognized as a combustion stroke according to the memory-based crank angle, for example, at 252 degrees that represent the incorrect crank angle storage determination timing $t_{JUD}$, the actual crank angle is determined, based on the TDC and CRK pulse shapes, to enter a compression stroke. In FIG. 19(*b*), the INJ SIGNAL and finished fuel injection flag F_INJ denoted by the solid lines represent the case of a conventional technique. The INJ SIGNAL and finished fuel injection flag F_INJ denoted by the dashed-dotted lines represent portions, in this embodiment, altered from the conventional technique.

As indicated by the INJ SIGNAL, the first fuel injection is turned on only during a predetermined period from $t_1$ to $t_2$ (the fuel injection timing), the $t_1$ being a start point of the INJOB timing of a predetermined crank angle during a compression stroke according to the memory-based crank angle. Then, the finished fuel injection flag F_INJ is set (=1) at the timing $t_1$ at which the INJ SIGNAL is turned on. At the incorrect crank angle storage determination timing $t_{JUD}$, namely the time of determining storage of incorrect crank angle, the initiation of an intake stroke has already been passed. Thus, the finished fuel injection flag F_INJ remains 1 as denoted by the solid line. Accordingly, during a predetermined period from $t_{1N}$ to $t_{2N}$ within the next compression stroke, the fuel injection control cannot be executed in the conventional technique. Specifically, as illustrated in step S43 of the detailed flow chart regarding a process for executing a fuel injection in FIG. 7, when the finished fuel injection flag F_INJ(i) is not 1, it is possible to go to step S44 to perform a fuel injection.

This embodiment, however, determines storage of incorrect crank angle at the timing $t_{JUD}$ as illustrated in FIG. 19(*b*), and corrects a stroke recognized by the ECU. In the fuel injection-controlling device 215B, the actual crank angle FIINJAGLCR(i) indicating the first fuel injection timing is 60 degrees as described in FIG. 18. The CYLJUDAGL(i), a crank angle advance from the first fuel injection timing, is 240 degrees. Hence, ITKJUDAGL=60-240=−180 degrees, which do not exceed 0 degrees. Accordingly, the finished fuel injection flag F_INJ, which has already been set, is cleared (=0) as designated by the dashed-dotted line after the incorrect crank angle storage determination timing tam. As a result, in the fuel injection-controlling device 215B, the finished fuel injection flag F_INJ is reset. Thus, as designated by the dashed-dotted line, when the next fuel injection is performed according to the actual crank angle, the INJ SIGNAL is output during a period from $t_{1N}$ to $t_{2N}$ within a compression stroke. As associated with the INJ SIGNAL, the finished fuel injection flag F_INJ is set during a period from $t_{1N}$ to $t_{3N}$ as designated by the dashed-dotted line.

As illustrated in FIG. 19(*b*), when the first fuel injection (the INJ SIGNAL during $t_1$ to $t_2$) is converted to that at the actual crank angle, the first fuel injection has been executed during an exhaust stroke. Accordingly, the whole fuel is exhausted. If fuel is not injected during a period from $t_{1N}$ to $t_{2N}$ within the next compression stroke, the period being the first fuel injection timing after the determination of the actual stroke at the incorrect crank angle storage determination timing $t_{JUD}$, this cylinder is going to misfire. Thus, the engine rotation at the time of starting the engine cannot be smooth. Hence, the fuel injection-controlling device 215B controls whether or not the next fuel injection of the #i cylinder at the expected first fuel injection timing after the determination of the actual stroke is to be performed as follows: whether or not fuel for the first fuel injection based on the stored crank angle CA(i) before the determination of the actual stroke is combusted in the cylinder or is exhausted outside the cylinder at the actual stroke is determined by INTKJUDAGL(i), which is an angle to determine whether or not fuel for the #i cylinder at the next cycle is injected.

In addition, control that an amount of the first fuel injection is subtracted from an amount of the next fuel injection, as described in Patent Literature 1 as a conventional technique, is not carried out. This can prevent misfire due to shortage of the amount of the next fuel injection. That is, deterioration of starting characteristics can be prevented.

Meanwhile, the determination by the INTKJUDAGL(i), which is an angle to determine whether or not fuel for the #i cylinder at the next cycle is injected, corresponds to "which determines whether or not fuel to be injected at a first fuel injection timing after the determination of the actual stroke is combined at the same combustion timing" set forth in the appended Claims.

Figure 20A:
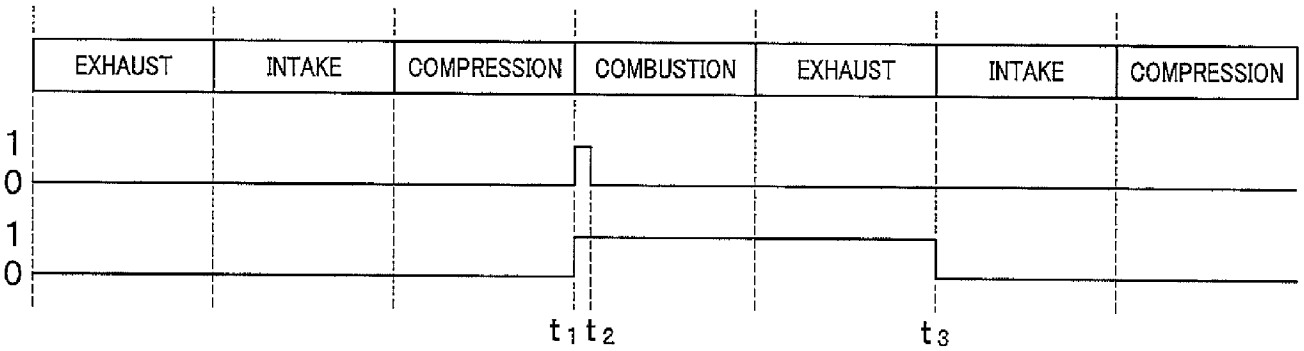
FIG. 20 illustrates a procedure for correcting a finished fuel injection flag in the case of injection during a combustion stroke in a direct-injection engine.
Figure 20B:
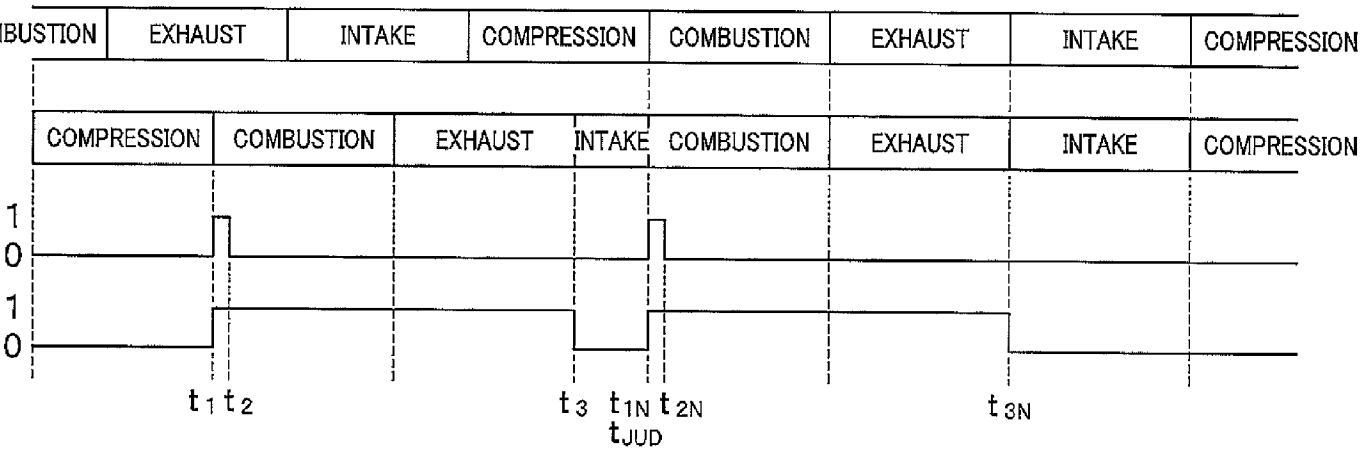

FIG. 20 illustrates a procedure for correcting a finished fuel injection flag in the case of injection during a combustion stroke in a direct-injection engine. FIG. 20(*a*) illustrates a normal driving condition. FIG. 20(*b*) illustrates how to correct a finished fuel injection flag in Example 2 which represents storage of incorrect crank angle at the time of stating an engine. FIG. 20(*a*) illustrates a normal driving condition. In that case, the INJ SIGNAL is turned on (in FIG. 20, designated as "1") only during a predetermined period from $t_1$ to $t_2$, the $t_1$ being a start point of the INJOB timing of a predetermined crank angle during a combustion stroke. The predetermined period from $t_1$ to $t_2$ is modified by an amount of fuel injection according to the torque requirement and environmental conditions such as an engine temperature.

The finished fuel injection flag F_INJ is set (=1) when the INJ SIGNAL is turned on, for example, it reaches the timing $t_1$. When a stroke reaches an intake stroke, the F_INJ is reset (=0) at the timing $t_3$ so as to make the next fuel injection possible.

FIG. 20(*b*) includes a bar chart indicating an actual stroke, a bar chart indicating a stoke recognized by the CPU of the engine controller ECU 27B (in the figure, designated as "ECU-RECOGNIZED STROKE"), an INJ SIGNAL, and a finished fuel injection flag F_INJ. FIG. 20(*b*) illustrates an example as follows: the first fuel injection is performed according to the memory-based crank angle at the time of starting the engine; and then, partway through a stroke that is recognized as an intake stroke according to the memory-based crank angle, for example, at 660 degrees that represent the incorrect crank angle storage determination timing $t_{JUD}$, the actual crank angle is determined, based on the TDC and CRK pulse shapes, to enter a combustion stroke.

As indicated by the INJ SIGNAL, the first fuel injection is turned on only during a predetermined period from $t_1$ to $t_2$ (the fuel injection timing), the $t_1$ being a start point of the INJOB timing of a predetermined crank angle during a combustion stroke according to the memory-based crank angle. Then, the finished fuel injection flag F_INJ is set (=1) at the timing $t_1$ at which the INJ SIGNAL is turned on. Before the incorrect crank angle storage determination timing $t_{JUD}$, that is, before determination of storage of incorrect crank angle, the initiation of an intake stroke is recognized to have passed. Thus, the finished fuel injection flag F_INJ is reset to 0 at the timing $t_3$ as denoted by the solid line. Accordingly, the conventional technique allows the fuel injection control to be executed even during a predetermined period from $t_{1N}$ to $t_{2N}$ within the next combustion stroke after the incorrect crank angle storage determination timing $t_{JUD}$. Specifically, as illustrated in step S43 of the detailed flow chart regarding a process for executing a fuel injection in FIG. 7, when the finished fuel injection flag F_INJ(i) is not 1, it is possible to go to step S44 to perform a fuel injection.

This embodiment, however, determines storage of incorrect crank angle at the timing $t_{JUD}$ as illustrated in FIG. 20(*b*), and corrects a stroke recognized by the ECU. In the fuel injection-controlling device 215B, the actual crank angle FIINJAGLCR(i) indicating the first fuel injection timing is 60 degrees as described in FIG. 18. The CYLJUDAGL(i), a crank angle advance from the first fuel injection timing, is 420 degrees. Hence, ITKJUDAGL=60−420=−360 degrees, which do not exceed 0 degrees. Accordingly, the finished fuel injection flag F_INJ stays 0 after the incorrect crank angle storage determination timing $t_{JUD}$. As a result, in the fuel injection-controlling device 215B, the finished fuel injection flag F_INJ remains 0. Thus, as designated by the solid line, when the next fuel injection is performed according to the actual crank angle, the INJ SIGNAL is output during a period from $t_{1N}$ to $t_{2N}$ within a compression stroke. As associated with the INJ SIGNAL, the finished fuel injection flag F_INJ is set during a period from $t_{1N}$ to $t_{3N}$ as designated by the dashed-dotted line.

As illustrated in FIG. 20(*b*), when the first fuel injection (the INJ SIGNAL during $t_1$ to $t_2$) is converted to that at the actual crank angle, the first fuel injection has been completed within an exhaust stroke, so that the whole injected fuel has been exhausted. If fuel is not injected during a period from $t_{1N}$ to $t_{2N}$ within the next combustion stroke, this cylinder is going to misfire. Thus, the engine rotation at the time of starting the engine cannot be smooth.

In view of the above, regardless of the case of fuel injection during a compression or combustion stroke in a direct-injection engine, this embodiment can appropriately control the next fuel injection of the same cylinder after the incorrect crank angle storage determination $t_{JUD}$, following the first fuel injection according to the memory-based crank angle. This can prevent misfire and emission deterioration due to double injection.

Note that in the first and second embodiments, after completion of booting the engine controllers ECU 27A and 27B by ON-operation of the IG-SW 111, the crank angle CA(i) of each of cylinders #i is always updated and stored in the crank angle storage devices 211*a* to 211*d* using a non-volatile memory. Embodiments, however, are not limited to this setting. Only if the IG-SW 111 has been turned off, the crank angle CA(i) of each of cylinders #i may be updated and stored in the crank angle storage devices 211*a* to 211*d* until the engine stoppage. After the start of the engine, only temporary storage may be employed.

Note that in the first and second embodiments, an inline 4-cylinder engine has been described as an example. Embodiments, however, are not limited to the above embodiments. Embodiments of the present invention are applicable to an inline 6-cylinder engine, an inline 8-cylinder engine, a V-shaped 6-cylinder engine, and other engines.

REFERENCE SIGNS LIST

7 Regulator
10 Throttle valve driving motor
11 Intake air temperature sensor
14 Air flow meter
16 Throttle position sensor
18 Intake air pressure sensor
20A, 20B Fuel injection valve
24 Exhaust gas sensor
25 Water temperature sensor
26 Crank sensor (Driving condition-detecting unit, Actual stroke-determining unit)
27A, 27B Engine controller ECU (Internal-combustion engine controller)
27*a* Microcomputer
28 TDC sensor (Actual stroke-determining unit)
41 Fuel pressure sensor
43 Accelerator position sensor (Driving condition-detecting unit)
45 Vehicle speed sensor (Driving condition-detecting unit)
210 Engine speed calculator (Driving condition-detecting unit)
211A, 211B Timing controlling device (Actual stroke-determining unit)
211*a*, 211*b*, 211*c*, 211*d* Crank angle storage device (Cylinder-determining information storing unit)
212 Output requirement calculator (Driving condition-detecting unit)
214A, 214B Fuel supply system-controlling device
215A, 215B Fuel injection-controlling device (Fuel injection-controlling unit)
216 Ignition timing-controlling device

The invention claimed is:

1. An internal-combustion engine controller for an internal-combustion engine including cylinders, a crank sensor, and a top dead center (TDC) sensor, the internal-combustion engine controller comprising:

a cylinder-determining information storing unit that stores as cylinder-determining information an actual crank angle of each cylinder at a time of stopping the internal-combustion engine;

an actual stroke-determining unit that:

reads a signal from the crank sensor and a signal from the TDC sensor, estimates a current crank angle of each cylinder based on the actual crank angle at the time of stopping the internal-combustion engine stored in the cylinder-determining information storing unit and the signal read from the crank sensor, determines, based on the signals read from the crank sensor and the TDC sensor, a current actual crank angle of each cylinder and thereby determines a current actual stroke of each cylinder, and calculates a difference between the estimated crank angle and the determined actual crank angle;

a fuel injection-controlling unit that:

performs an initial fuel injection toward a predetermined cylinder at a timing based on the estimated crank angle of the predetermined cylinder, the initial fuel injection being a fuel injection performed first toward the predetermined cylinder during a time of starting the internal-combustion engine and before the determination of the actual stroke, calculates a crank angle advance from the timing of the initial fuel injection toward the predetermined cylinder to a timing of the determination of the actual stroke by the actual stroke-determining unit, and injects, after the determination of the actual stroke by the actual stroke-determining unit, an amount of fuel injection corresponding to a driving condition at a fuel injection timing corresponding to the actual stroke to start the internal-combustion engine; and an injection timing-determining unit that:

calculates, based on the estimated crank angle at the timing of the initial fuel injection toward the predetermined cylinder and the difference calculated by the actual stroke-determining unit, an actual crank angle at the timing of the initial fuel injection toward the predetermined cylinder, calculates, based on the calculated actual crank angle and the crank angle advance from the timing of the initial fuel injection toward the predetermined cylinder to the timing of the determination of the actual stroke, the crank angle advance being calculated by the fuel injection-controlling unit, an angle to determine whether to inject fuel for the predetermined cylinder at a next cycle, and determines, by comparing the calculated angle to determine whether to inject fuel for the predetermined cylinder at the next cycle with a predetermined angle, whether or not fuel injected in the initial fuel injection toward the predetermined cylinder and fuel to be injected toward the predetermined cylinder at a first-coming fuel injection timing after the determination of the actual stroke of the predetermined cylinder by the actual stroke-determining unit are combined at the same combustion timing, the fuel injection toward the predetermined cylinder at the first-coming fuel injection timing being a fuel injection to be performed first after the determination of the actual stroke of the predetermined cylinder, wherein the fuel injection-controlling unit controls, based on a result of the determination by the injection timing-determining unit, a fuel injection at the first-coming fuel injection timing after the determination of the actual stroke of the predetermined cylinder.

2. The internal-combustion engine controller according to claim 1, wherein when the injection timing-determining unit determines that the fuel injected in the initial fuel injection toward the predetermined cylinder and the fuel to be injected at the first-coming fuel injection timing after the determination of the actual stroke of the predetermined cylinder are not combined at the same combustion timing, the fuel injection-controlling unit controls a fuel injection at the amount of fuel injection corresponding to the driving condition at the first-coming fuel injection timing after the determination of the actual stroke of the predetermined cylinder; and wherein when the injection timing-determining unit determines that the fuel injected in the initial fuel injection toward the predetermined cylinder and the fuel to be injected at the first-coming fuel injection timing after the determination of the actual stroke of the predetermined cylinder are combined at the same combustion timing, the fuel injection-controlling unit does not perform a fuel injection at the first-coming fuel injection timing after the determination of the actual stroke of the predetermined cylinder.

3. The internal-combustion engine controller according to claim 1, wherein the internal-combustion engine is a port-injection internal-combustion engine whose fuel injection valve is disposed in an intake passage; and the injection timing-determining unit determines whether or not the fuel injected in the initial fuel injection toward the predetermined cylinder and the fuel to be injected at the first-coming fuel injection timing after the determination of the actual stroke of the predetermined cylinder are combined at the same combustion timing, by determining whether or not a stroke at the determination of the actual stroke of the predetermined cylinder is before bottom dead center during an intake stroke.

4. The internal-combustion engine controller according to claim 2, wherein the internal-combustion engine is a port-injection internal-combustion engine whose fuel injection valve is disposed in an intake passage; and the injection timing-determining unit determines whether or not the fuel injected in the initial fuel injection toward the predetermined cylinder and the fuel to be injected at the first-coming fuel injection timing after the determination of the actual stroke of the predetermined cylinder are combined at the same combustion timing, by determining whether or not a stroke at the determination of the actual stroke of the predetermined cylinder is before bottom dead center during an intake stroke.

5. The internal-combustion engine controller according to claim 1, wherein the internal-combustion engine is a direct-injection internal-combustion engine whose fuel injection valve is disposed toward a combustion chamber; and the injection timing-determining unit determines whether or not the fuel injected in the initial fuel injection toward the predetermined cylinder and the fuel to be injected at the first-coming fuel injection timing after the determination of the actual stroke of the predetermined cylinder are combined at the same combustion timing, by determining whether or not a stroke at the determination of the actual stroke of the predetermined cylinder is before top dead center during an exhaust stroke.

6. The internal-combustion engine controller according to claim 2, wherein the internal-combustion engine is a direct-injection internal-combustion engine whose fuel injection valve is disposed toward a combustion chamber; and the injection timing-determining unit determines whether or not the fuel injected in the initial fuel injection toward the predetermined cylinder and the fuel to be injected at the first-coming fuel injection timing after the determination of the actual stroke of the predetermined cylinder are combined at the same combustion timing, by determining whether or not a stroke at the determination of the actual stroke of the predetermined cylinder is before top dead center during an exhaust stroke.

7. The internal-combustion engine controller according to claim 1, wherein the initial fuel injection toward the predetermined cylinder is performed at a timing of promoting a quick start of the internal-combustion engine.

8. The internal-combustion engine controller according to claim 7, wherein when the injection timing-determining unit determines that the fuel injected in the initial fuel injection toward the predetermined cylinder and the fuel to be injected at the first-coming fuel injection timing after the determination of the actual stroke of the predetermined cylinder are not combined at the same combustion timing, the fuel injection-controlling unit controls a fuel injection at the amount of fuel injection corresponding to the driving condition at the first-coming fuel injection timing after the determination of the actual stroke of the predetermined cylinder; and wherein when the injection timing-determining unit determines that the fuel injected in the initial fuel injection toward the predetermined cylinder and the fuel to be injected at the first-coming fuel injection timing after the determination of the actual stroke of the predetermined cylinder are combined at the same combustion timing, the fuel injection-controlling unit does not perform a fuel injection at the first-coming fuel injection timing after the determination of the actual stroke of the predetermined cylinder.

9. The internal-combustion engine controller according to claim 7, wherein the internal-combustion engine is a port-injection internal-combustion engine whose fuel injection valve is disposed in an intake passage; and the injection timing-determining unit determines whether or not the fuel injected in the initial fuel injection toward the predetermined cylinder and the fuel to be injected at the first-coming fuel injection timing after the determination of the actual stroke of the predetermined cylinder are combined at the same combustion timing, by determining whether or not a stroke at the determination of the actual stroke of the predetermined cylinder is before bottom dead center during an intake stroke.

10. The internal-combustion engine controller according to claim 7, wherein the internal-combustion engine is a direct-injection internal-combustion engine whose fuel injection valve is disposed toward a combustion chamber; and the injection timing-determining unit determines whether or not the fuel injected in the initial fuel injection toward the predetermined cylinder and the fuel to be injected at the first-coming fuel injection timing after the determination of the actual stroke of the predetermined cylinder are combined at the same combustion timing, by determining whether or not a stroke at the determination of the actual stroke of the predetermined cylinder is before top dead center during an exhaust stroke.

11. The internal-combustion engine controller according to claim 8, wherein the internal-combustion engine is a port-injection internal-combustion engine whose fuel injection valve is disposed in an intake passage; and the injection timing-determining unit determines whether or not the fuel injected in the initial fuel injection toward the predetermined cylinder and the fuel to be injected at the first-coming fuel injection timing after the determination of the actual stroke of the predetermined cylinder are combined at the same combustion timing, by determining whether or not a stroke at the determination of the actual stroke of the predetermined cylinder is before bottom dead center during an intake stroke.

12. The internal-combustion engine controller according to claim 8, wherein the internal-combustion engine is a direct-injection internal-combustion engine whose fuel injection valve is disposed toward a combustion chamber; and the injection timing-determining unit determines whether or not the fuel injected in the initial fuel injection toward the predetermined cylinder and the fuel to be injected at the first-coming fuel injection timing after the determination of the actual stroke of the predetermined cylinder are combined at the same combustion timing, by determining whether or not a stroke at the determination of the actual stroke of the predetermined cylinder is before top dead center during an exhaust stroke.

* * * * *